US010764709B2

(12) United States Patent
Breebaart et al.

(10) Patent No.: US 10,764,709 B2
(45) Date of Patent: Sep. 1, 2020

(54) METHODS, APPARATUS AND SYSTEMS FOR DYNAMIC EQUALIZATION FOR CROSS-TALK CANCELLATION

(71) Applicant: DOLBY LABORATORIES LICENSING CORPORATION, San Francisco, CA (US)

(72) Inventors: Dirk Jeroen Breebaart, Ultimo (AU); Alan J. Seefeldt, Alameda, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/477,870

(22) PCT Filed: Jan. 10, 2018

(86) PCT No.: PCT/US2018/013085

§ 371 (c)(1),
(2) Date: Jul. 12, 2019

(87) PCT Pub. No.: WO2018/132417

PCT Pub. Date: Jul. 19, 2018

(65) Prior Publication Data

US 2019/0373398 A1 Dec. 5, 2019

Related U.S. Application Data

(60) Provisional application No. 62/592,906, filed on Nov. 30, 2017, provisional application No. 62/446,165, filed on Jan. 13, 2017.

(51) Int. Cl.

| | |
|---|---|
| ***H04S 7/00*** | (2006.01) |
| ***H04R 3/14*** | (2006.01) |
| ***H04S 3/00*** | (2006.01) |

(52) U.S. Cl.

CPC ..... *H04S 7/307* (2013.01); *H04R 3/14* (2013.01); *H04S 3/008* (2013.01); *H04S 7/303* (2013.01);

(Continued)

(58) Field of Classification Search

CPC ..... H04S 7/307; H04S 7/303; H04S 7/301; H04S 7/302; H04S 7/304; H04S 3/008;

(Continued)

(56) References Cited

U.S. PATENT DOCUMENTS

| | | | |
|---|---|---|---|
| 5,590,204 | A | 12/1996 | Lee |
| 6,009,178 | A | 12/1999 | Abel |

(Continued)

FOREIGN PATENT DOCUMENTS

| | | |
|---|---|---|
| WO | 2012093352 | 7/2012 |
| WO | 2013006338 | 1/2013 |

(Continued)

OTHER PUBLICATIONS

Brandenburg, K. et. al., "Overview of MPEG Audio: Current and Future Standards for Low-Bit-Rate Audio Coding" Journal Audio Engineering Society, vol. 45, No. 1/2, Jan./Feb. 1997 (18 pgs.).

(Continued)

*Primary Examiner* — Ahmad F. Matar
*Assistant Examiner* — Sabrina Diaz

(57) ABSTRACT

A first playback stream presentation intended for reproduction on a first audio reproduction system and transform parameters may be received and decoded. The second playback stream presentation may be intended for reproduction on headphones. The transform parameters may be applied to an intermediate playback stream presentation to obtain the second playback stream presentation. The intermediate playback stream presentation may be the first playback stream presentation, a downmix of the first playback stream presentation, or an upmix of the first playback stream presentation. A cross-talk-cancelled signal may be obtained by processing the second playback stream presentation with a cross-talk cancellation algorithm. The cross-talk-cancelled signal may be processed by a dynamic equalization or gain (Continued)

stage wherein an amount of equalization or gain may be dependent on a level of the first playback stream presentation or the second playback stream presentation.

21 Claims, 18 Drawing Sheets

(52) U.S. Cl.
CPC ..... *H04S 2400/01* (2013.01); *H04S 2400/03* (2013.01); *H04S 2400/13* (2013.01); *H04S 2420/01* (2013.01)

(58) Field of Classification Search
CPC .... H04S 3/00; H04S 2400/01; H04S 2400/03; H04S 2400/13; H04S 2420/01; H04S 1/002; H04S 1/005; H04S 1/007; H04R 3/12; H04R 3/14; H04R 5/02; H04R 2205/02
USPC ..... 381/303, 300, 310
See application file for complete search history.

(56) References Cited

U.S. PATENT DOCUMENTS 6,078,669 A 6/2000 Maher
6,668,061 B1 * 12/2003 Abel ..... H04S 1/002 381/1
6,771,778 B2 8/2004 Kirkeby
7,440,575 B2 10/2008 Kirkeby
8,155,323 B2 4/2012 Chabanne
8,320,592 B2 * 11/2012 Kim ..... H04S 1/00 381/17
9,445,213 B2 9/2016 Xiang
9,622,011 B2 4/2017 Seefeldt
2011/0243338 A1 * 10/2011 Brown ..... H04S 3/002 381/17
2015/0172812 A1 6/2015 Wu
2016/0249161 A1 8/2016 Roskind
2018/0233156 A1 8/2018 Breebaart
2019/0035410 A1 1/2019 Breebaart

FOREIGN PATENT DOCUMENTS

WO 2014035728 3/2014
WO 2017035281 A3 5/2017

OTHER PUBLICATIONS

Gardner, W., "3-D Audio Using Loud speakers", Programs in Media Arts & Sciences, Aug. 8, 1997 (153 pgs.).
Herre, J. et. al., "MPEG Surround—The ISO/MPEG Standard for Efficient and Compatible Multichannel Audio Coding", Journal Audio Engineering Society, vol. 56, No. 11, Nov. 2008 (24 pgs.).
Riedmiller, J., et. al., "Immersive and Personalized Audio: A Practical System for Enabling Interchange, Distribution, and Delivery of Next-Generation Audio Experiences" SMPTE Motion Imaging Journal, Jul.-Aug. 2015 (23 pgs.).

* cited by examiner

1700

METHODS, APPARATUS AND SYSTEMS FOR DYNAMIC EQUALIZATION FOR CROSS-TALK CANCELLATION

CROSS-REFERENCE TO RELATED APPLICATIONS

This application is a U.S. 371 national phase of International Patent Application No. PCT/US2018/013085 and claims the benefit of priority from U.S. Provisional Patent Application No. 62/446,165, filed on Jan. 13, 2017 and U.S. Provisional Patent Application No. 62/592,906 filed Nov. 30, 2017 entitled "DYNAMIC EQUALIZATION FOR CROSS-TALK CANCELLATION," which are hereby incorporated by reference in their entirety.

TECHNICAL FIELD

The present disclosure relates to the field of audio processing, including methods and systems for processing immersive audio content.

BACKGROUND

The Dolby Atmos system provides an audio object format system. For example, immersive audio content, in a format such as the Dolby Atmos format, may consist of dynamic objects (e.g. object signals with time-varying metadata) and static objects, also referred to as beds, consisting of one or more named channels (e.g., left front, center, rear top surround, etc). The present disclosure relates to the field of audio processing, including methods and systems for processing immersive audio content.

The time-varying metadata of dynamic objects can describe one or more attributes of each object, such as:

- the position of the object as a function of time, for example in terms of azimuth and elevation angles, or Cartesian coordinates;
- semantic labels, such as music, effects, or dialog;
- spatial rendering attributes informative of how the object will be rendered on loudspeakers, such as spatial zone masks, snap flags, or object size;
- spatial rendering attributes informative of how the object will be rendered on headphones, such as a binaural simulation of an object close to the listener ('near'), far away from the listener ('far') or not requiring binaural simulation at all ('bypass').

When a substantial number of objects are used concurrently, e.g., in Dolby Atmos content, the transmission and rendering of the vast number of elements can be challenging, especially on mobile devices operating on battery power.

SUMMARY

Various audio processing methods are disclosed herein. Some methods may involve decoding a playback stream presentation from a data stream. For example, such methods may involve decoding a first playback stream presentation that is configured for reproduction on a first audio reproduction system and decoding transform parameters suitable for transforming an intermediate playback stream into a second playback stream presentation. The second playback stream presentation may be configured for reproduction on headphones. The intermediate playback stream presentation may be the first playback stream presentation, a downmix of the first playback stream presentation and/or an upmix of the first playback stream presentation.

The methods may involve applying the transform parameters to the intermediate playback stream presentation to obtain the second playback stream presentation and processing the second playback stream presentation by a cross-talk cancellation algorithm to obtain a cross-talk-cancelled signal. Some methods may involve processing the cross-talk-cancelled signal by a dynamic equalization or gain stage in which an amount of equalization or gain is dependent on a level of the first playback stream presentation or the second playback stream presentation, to produce a modified version of the cross-talk-cancelled signal. The methods may involve outputting the modified version of the cross-talk-cancelled signal.

In some examples, the cross-talk cancellation algorithm may be based, at least in part, on loudspeaker data. The loudspeaker data may include loudspeaker position data. According to some implementations, the amount of dynamic equalization or gain may be based, at least in part, on acoustic environment data. In some implementations, the acoustic environment data may include data that are representative of the direct-to-reverberant ratio at the intended listening position. In some examples, the dynamic equalization or gain may be frequency-dependent. According to some implementations, the acoustic environment data may be frequency-dependent. Some such methods may involve playing back the modified version of the cross-talk-cancelled signal on headphones.

Some alternative methods may involve virtually rendering channel-based or object-based audio. Some such methods may involve receiving one or more input audio signals and data corresponding to an intended position of at least one of the input audio signals, and generating a binaural signal pair for each input signal of the one or more input signals. The binaural signal pair may be based on an intended position of the input signal. Some such methods may involve applying a cross-talk cancellation process to the binaural signal pair to obtain a cross-talk cancelled signal pair and measuring a level of the cross-talk cancelled signal pair. Such methods may involve measuring a level of the input audio signals and applying a dynamic equalization or gain to the cross-talk cancelled signal pair in response to a measured level of the cross-talk cancelled signal pair and a measured level of the input audio, to produce a modified version of the cross-talk-cancelled signal. Some methods may involve outputting the modified version of the cross-talk-cancelled signal.

In some examples, the dynamic equalization or gain may be based, at least in part, on a function of time or frequency. In some instances, the level estimates may be based, at least in part, on summing the levels across channels or objects. According to some implementations, levels may be based at least in part, energy, power, loudness and/or amplitude. At least part of the processing may be implemented in a transform or filterbank domain.

According to some examples, the cross-talk cancellation algorithm may be based, at least in part, on loudspeaker data. In some implementations, the loudspeaker data may include loudspeaker position data. According to some examples, the amount of dynamic equalization or gain may be based, at least in part, on acoustic environment data. The acoustic environment data may include data that is representative of the direct-to-reverberant ratio at the intended listening position. In some examples, the dynamic equalization, the gain and/or the acoustic environment data may be frequency-dependent.

Some methods may involve summing the binaural signal pairs or the cross-talk cancelled signal pairs together to produce a summed binaural signal pair. According to some such examples, the cross-talk cancellation process may be applied to the summed binaural signal pair.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in one or more non-transitory media having software stored thereon. The software may, for example, include instructions for controlling at least one device to process audio data. The software may, for example, be executable by one or more components of a control system such as those disclosed herein.

According to some examples, the software may include instructions for controlling one or more devices to perform a method. The method may involve decoding a playback stream presentation from a data stream. For example, some methods may involve decoding a first playback stream presentation that is configured for reproduction on a first audio reproduction system and decoding transform parameters suitable for transforming an intermediate playback stream into a second playback stream presentation. The second playback stream presentation may be configured for reproduction on headphones. The intermediate playback stream presentation may be the first playback stream presentation, a downmix of the first playback stream presentation and/or an upmix of the first playback stream presentation.

The methods may involve applying the transform parameters to the intermediate playback stream presentation to obtain the second playback stream presentation and processing the second playback stream presentation by a cross-talk cancellation algorithm to obtain a cross-talk-cancelled signal. Some methods may involve processing the cross-talk-cancelled signal by a dynamic equalization or gain stage in which an amount of equalization or gain is dependent on a level of the first playback stream presentation or the second playback stream presentation, to produce a modified version of the cross-talk-cancelled signal. The methods may involve outputting the modified version of the cross-talk-cancelled signal.

In some examples, the cross-talk cancellation algorithm may be based, at least in part, on loudspeaker data. The loudspeaker data may include loudspeaker position data. According to some implementations, the amount of dynamic equalization or gain may be based, at least in part, on acoustic environment data. In some implementations, the acoustic environment data may include data that are representative of the direct-to-reverberant ratio at the intended listening position. In some examples, the dynamic equalization or gain may be frequency-dependent. According to some implementations, the acoustic environment data may be frequency-dependent. Some such methods may involve playing back the modified version of the cross-talk-cancelled signal on headphones.

According to some alternative implementations, the software may include instructions for controlling one or more devices to perform an alternative method. The method may involve virtually rendering channel-based or object-based audio. Some such methods may involve receiving one or more input audio signals and data corresponding to an intended position of at least one of the input audio signals, and generating a binaural signal pair for each input signal of the one or more input signals. The binaural signal pair may be based on an intended position of the input signal.

Some such methods may involve applying a cross-talk cancellation process to the binaural signal pair to obtain a cross-talk cancelled signal pair and measuring a level of the cross-talk cancelled signal pair. Such methods may involve measuring a level of the input audio signals and applying a dynamic equalization or gain to the cross-talk cancelled signal pair in response to a measured level of the cross-talk cancelled signal pair and a measured level of the input audio, to produce a modified version of the cross-talk-cancelled signal. Some methods may involve outputting the modified version of the cross-talk-cancelled signal.

In some examples, the dynamic equalization or gain may be based, at least in part, on a function of time or frequency. In some instances, the level estimates may be based, at least in part, on summing the levels across channels or objects. According to some implementations, levels may be based at least in part, energy, power, loudness and/or amplitude. At least part of the processing may be implemented in a transform or filterbank domain.

According to some examples, the cross-talk cancellation algorithm may be based, at least in part, on loudspeaker data. In some implementations, the loudspeaker data may include loudspeaker position data. According to some examples, the amount of dynamic equalization or gain may be based, at least in part, on acoustic environment data. The acoustic environment data may include data that is representative of the direct-to-reverberant ratio at the intended listening position. In some examples, the dynamic equalization, the gain and/or the acoustic environment data may be frequency-dependent.

Some methods may involve summing the binaural signal pairs or the cross-talk cancelled signal pairs together to produce a summed binaural signal pair. According to some such examples, the cross-talk cancellation process may be applied to the summed binaural signal pair.

At least some aspects of the present disclosure may be implemented via apparatus. For example, one or more devices may be configured for performing, at least in part, the methods disclosed herein. In some implementations, an apparatus may include an interface system and a control system. The interface system may include one or more network interfaces, one or more interfaces between the control system and a memory system, one or more interfaces between the control system and another device and/or one or more external device interfaces. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. The interface and/or control systems may include one or more receivers and/or processing units and/or outputting units configured to perform aspects of the present invention.

The control system may be configured for performing, at least in part, the methods disclosed herein. In some implementations, the control system may be configured for decoding a first playback stream presentation received via the interface system, the first playback stream presentation configured for reproduction on a first audio reproduction system. The control system may be configured for decoding transform parameters received via the interface system. The transform parameters may be suitable for transforming an intermediate playback stream into a second playback stream presentation that is configured for reproduction on headphones. The intermediate playback stream presentation may be the first playback stream presentation, a downmix of the first playback stream presentation and/or an upmix of the first playback stream presentation.

In some implementations, the control system may be configured for applying the transform parameters to the intermediate playback stream presentation to obtain the second playback stream presentation processing the second playback stream presentation by a cross-talk cancellation algorithm to obtain a cross-talk-cancelled signal. The control system may be configured for processing the cross-talk-cancelled signal by a dynamic equalization or gain stage in which an amount of equalization or gain may be dependent on a level of the first playback stream presentation or the second playback stream presentation, to produce a modified version of the cross-talk-cancelled signal. The control system may be configured for outputting, via the interface system, a modified version of the cross-talk-cancelled signal.

According to some examples, the cross-talk cancellation algorithm may be based, at least in part, on loudspeaker data. In some implementations, the loudspeaker data may include loudspeaker position data. According to some examples, the amount of dynamic equalization or gain may be based, at least in part, on acoustic environment data. The acoustic environment data may include data that is representative of the direct-to-reverberant ratio at the intended listening position. In some examples, the dynamic equalization, the gain and/or the acoustic environment data may be frequency-dependent.

According to some implementations, the apparatus (or a system that includes the apparatus) may include headphones. In some such implementations, the control system may be further configured for playing back the modified version of the cross-talk-cancelled signal on the headphones.

Alternative apparatus implementations are disclosed herein. In some implementations, an apparatus may include an interface system and a control system. According to some implementations, the control system may be configured for receiving one or more input audio signals and data corresponding to an intended position of at least one of the input audio signals and for generating a binaural signal pair for each input signal of the (e.g., via a receiver) one or more input signals. The binaural signal pair may be based on an intended position of the input signal.

The control system may be configured for applying a cross-talk cancellation process to the binaural signal pair to obtain a cross-talk cancelled signal pair, for measuring a level of the cross-talk cancelled signal pair and for measuring a level of the input audio signals. In some examples, the control system may be configured for applying a dynamic equalization or gain to the cross-talk cancelled signal pair in response to a measured level of the cross-talk cancelled signal pair and a measured level of the input audio, to produce a modified version of the cross-talk-cancelled signal. The control system may be configured for outputting, via the interface system, a modified version of the cross-talk-cancelled signal. The control system may perform this via one or multiple processing units. This control system may be configured for outputting. (e.g., via an outputting unit and/or via the interface system), a modified version of the cross-talk-cancelled signal.

In some implementations, the dynamic equalization or gain may be based, at least in part, on a function of time or frequency. In some instances, the level estimates may be based, at least in part, on summing the levels across channels or objects. According to some implementations, levels may be based at least in part, energy, power, loudness and/or amplitude. At least part of the processing may be implemented in a transform or filterbank domain.

According to some examples, the cross-talk cancellation algorithm may be based, at least in part, on loudspeaker data. In some implementations, the loudspeaker data may include loudspeaker position data. According to some examples, the amount of dynamic equalization or gain may be based, at least in part, on acoustic environment data. The acoustic environment data may include data that is representative of the direct-to-reverberant ratio at the intended listening position. In some examples, the dynamic equalization, the gain and/or the acoustic environment data may be frequency-dependent.

According to some implementations, the control system may be further configured for summing the binaural signal pairs or the cross-talk cancelled signal pairs together to produce a summed binaural signal pair. In some such implementations, the cross-talk cancellation process may be applied to the summed binaural signal pair.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

DESCRIPTION OF EXAMPLE EMBODIMENTS

Figure 1:
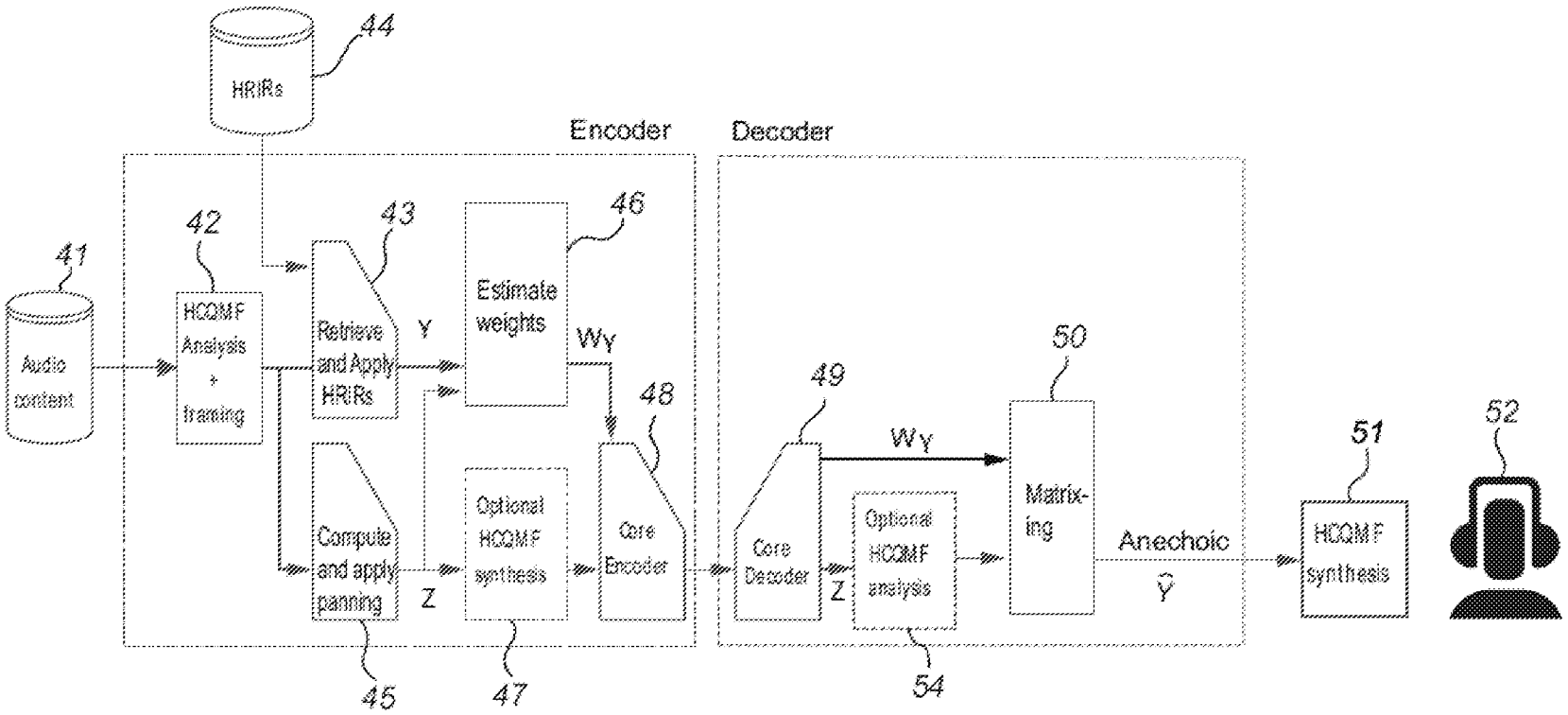
FIG. 1 illustrates schematically the production of coefficients w to process a loudspeaker presentation for headphone reproduction according to one example.

The following description is directed to certain implementations for the purposes of describing some innovative aspects of this disclosure, as well as examples of contexts in which these innovative aspects may be implemented. However, the teachings herein can be applied in various different ways. Moreover, the described embodiments may be implemented in a variety of hardware, software, firmware, etc. For example, aspects of the present application may be embodied, at least in part, in an apparatus, a system that includes more than one device, a method, a computer program product, etc. Accordingly, aspects of the present application may take the form of a hardware embodiment, a software embodiment (including firmware, resident software, microcodes, etc.) and/or an embodiment combining both software and hardware aspects. Such embodiments may be referred to herein in various ways, e.g., as a "circuit," a "module," a "stage" or an "engine." Some aspects of the present application may take the form of a computer program product embodied in one or more non-transitory media having computer readable program code embodied thereon. Such non-transitory media may, for example, include a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. Accordingly, the teachings of this disclosure are not intended to be limited to the implementations shown in the figures and/or described herein, but instead have wide applicability.

Dolby has developed methods for presentation transformations that can be used to efficiently transmit and decode immersive audio for headphones. Coding efficiency and decoding complexity reduction may be achieved by splitting the rendering process across encoder and decoder, rather than relying on the decoder to render all objects. In some examples, all rendering (for headphones and stereo loudspeaker playback) may be applied in the encoder, while the stereo loudspeaker presentation is encoded by a core encoder. The resulting bit stream may be accompanied by parametric data that allow the stereo loudspeaker presentation to be transformed into a binaural headphone presentation. The decoder may be configured to output the stereo loudspeaker presentation, the binaural headphone presentation or both presentations from a single bit stream.

FIGS. 1-4 illustrate various examples of a dual-ended system for delivering immersive audio on headphones. Within the context of Dolby AC-4, this dual-ended approach is referred to as AC-4 'Immersive Stereo'.

Some benefits of the dual-ended approach compared to a single-ended approach based on transmitting objects include:

- Coding efficiency: instead of having to encode a multitude of objects, this approach transmits a stereo signal with additional parameters to convert the stereo signal to a headphone presentation.
- Decoder complexity: the binaural rendering process of each individual object is applied in the encoder, which reduces the decoder complexity significantly.
- Loudspeaker compatibility: the stereo signal can be reproduced over loudspeakers.
- End-user acoustic environment simulation: the acoustic environment simulation (feedback delay network, or FDN in FIGS. 3 and 4) is applied at the end-user device and is therefore fully customizable in terms of type of environment that is simulated, as well as object distance.

In accordance with some examples, there is provided a method of encoding an input audio stream having one or more audio components, wherein each audio component is associated with a spatial location, the method including the steps of obtaining a first playback stream presentation of the input audio stream, the first playback stream presentation is a set of M1 signals intended for reproduction on a first audio reproduction system, obtaining a second playback stream presentation of the input audio stream, the second playback stream presentation is a set of M2 signals intended for reproduction on a second audio reproduction system, determining a set of transform parameters suitable for transforming an intermediate playback stream presentation to an approximation of the second playback stream presentation, wherein the intermediate playback stream presentation is one of the first playback stream presentation, a down-mix of the first playback stream presentation, and an up-mix of the first playback stream presentation, wherein the transform parameters are determined by minimization of a measure of a difference between the approximation of the second playback stream presentation and the second playback stream presentation, and encoding the first playback stream presentation and the set of transform parameters for transmission to a decoder.

In accordance with some implementations, there is provided a method of decoding playback stream presentations from a data stream, the method including the steps of receiving and decoding a first playback stream presentation, the first playback stream presentation being a set of M1 signals intended for reproduction on a first audio reproduction system, receiving and decoding a set of transform parameters suitable for transforming an intermediate playback stream presentation into an approximation of a second playback stream presentation, the second playback stream presentation being a set of M2 signals intended for reproduction on a second audio reproduction system, wherein the intermediate playback stream presentation is one of the first playback stream presentation, a down-mix of the first playback stream presentation, and an up-mix of the first playback stream presentation, wherein the transform parameters ensure that a measure of a difference between the approximation of the second playback stream presentation and the second playback stream presentation is minimized, and applying the transform parameters to the intermediate playback stream presentation to produce the approximation of the second playback stream presentation.

In some embodiments, the first audio reproduction system can comprise a series of speakers at fixed spatial locations and the second audio reproduction system can comprise a set of headphones adjacent a listener's ear. The first or second playback stream presentation may be an echoic or anechoic binaural presentation.

The transform parameters are preferably time varying and frequency dependent.

The transform parameters are preferably determined by minimization of a measure of a difference between: the result of the transform parameters applied to the first playback stream presentation and the second playback stream presentation.

In accordance with another implementation, there is provided a method for encoding audio channels or audio objects as a data stream, comprising the steps of: receiving N input audio channels or objects; calculating a set of M signals, wherein M≤N, by forming combinations of the N input audio channels or objects, the set of M signals intended for reproduction on a first audio reproduction system; calculating a set of time-varying transformation parameters W which transform the set of M signals intended for reproduction on first audio reproduction system to an approximation reproduction on a second audio reproduction system, the approximation reproduction approximating any spatialization effects produced by reproduction of the N input audio channels or objects on the second reproduction system; and combining the M signals and the transformation parameters W into a data stream for transmittal to a decoder.

In some embodiments, the transform parameters form an M1×M2 gain matrix, which may be applied directly to the first playback stream presentation to form said approximation of the second playback stream presentation. In some embodiments, M1 is equal to M2, i.e. both the first and second presentations have the same number of channels. In a specific case, both the first and second presentations are stereo presentations, i.e. M1=M2=2.

It will be appreciated by the person skilled in the art that the first presentation stream encoded in the encoder may be a multichannel loudspeaker presentation, e.g. a surround or immersive (3D) loudspeaker presentation such as a 5.1, 7.1, 5.1.2, 5.1.4, 7.1.2, or 7.1.4 presentation. In such a situation, to avoid, or minimize, an increase in computational complexity, according to one embodiment of the present invention, the step of determining a set of transform parameters may include downmixing the first playback stream presentation to an intermediate presentation with fewer channels, In a specific example, the intermediate presentation is a two-channel presentation. In this case, the transform parameters are thus suitable for transforming the intermediate two-channel presentation to the second playback stream presentation. The first playback stream presentation may be a surround or immersive loudspeaker presentation.

Stereo Content Reproduced Over Headphones, Including an Anechoic Binaural Rendering In this implementation, a stereo signal intended for loudspeaker playback is encoded, with additional data to enhance the playback of that loudspeaker signal on headphones. Given a set of input objects or channels $x_i[n]$, a set of loudspeaker signals $z_s[n]$ is typically generated by means of amplitude panning gains $g_{i,s}$ that represents the gain of object i to speaker s:

$$z_s[n]=\Sigma_i g_{i,s} x_i[n] \quad \text{Equation No. (1)}$$

For channel-based content, the amplitude panning gains $g_{i,s}$ are typically constant, while for object-based content, in which the intended position of an object is provided by time-varying object metadata, the gains will consequently be time variant.

Given the signals $z_s[n]$ to be encoded and decoded, it is desirable to find a set of coefficients w such that if these coefficients are applied to signals $z_s[n]$, the resulting modified signals $\hat{y}_l$, $\hat{y}_r$ constructed as:

$$\hat{y}_l=\Sigma_s s_{s,l} z_s \quad \text{Equation No. (2)}$$

$$\hat{y}_r=\Sigma_s s_{s,r} z_s \quad \text{Equation No. (3)}$$

closely match a binaural presentation of the original input signals $x_i[n]$ according to:

$$y_l[n]=\Sigma_i x_i[n]*h_{l,i}[n] \quad \text{Equation No. (4)}$$

$$y_r[n]=\Sigma_i x_i[n]*h_{r,i}[n] \quad \text{Equation No. (5)}$$

The coefficients w can be found by minimizing the L2 norm E between desired and actual binaural presentation:

$$E=|y_l-y_l|^2+|y_r-y_r|^2 \quad \text{Equation No. (6)}$$

$$w=\arg\min(E) \quad \text{Equation No. (7)}$$

The solution to minimize the error E can be obtained by closed-form solutions, gradient descent methods, or any other suitable iterative method to minimize an error function. As one example of such solution, one can write the various rendering steps in matrix notation:

$$Y=XH \quad \text{Equation No. (8)}$$

$$Z=XG \quad \text{Equation No. (9)}$$

$$\hat{Y}=XGW=ZW \quad \text{Equation No. (10)}$$

This matrix notation is based on single-channel frame containing N samples being represented as one column:

$$\vec{x}_i=\begin{bmatrix} x_i[0] \\ \vdots \\ x_i[N-1] \end{bmatrix} \quad \text{Equation No. (11)}$$

and matrices as combination of multiple channels i={1, . . . , l}, each being represented by one column vector in the matrix:

$$X=[\vec{x}_1 \ldots \vec{x}_l] \quad \text{Equation No. (12)}$$

The solution for W that minimizes E is then given by:

$$W=(G^*X^*XG+\epsilon 1)^{-1}G^*X^*XH \quad \text{Equation No. (13)}$$

with (*) the complex conjugate transpose operator, I the identity matrix, and E a regularization constant. This solution differs from the gain-based method in that the signal $\hat{Y}$ is generated by a matrix rather than a scalar W applied to signal Z including the option of having cross-terms (e.g. for example the second signal of $\hat{Y}$ being (partly) reconstructed from the first signal in Z).

Ideally, the coefficients w are determined for each time/frequency tile to minimize the error E in each time/frequency tile.

In the sections above, a minimum mean-square error criterion (L2 norm) is employed to determine the matrix coefficients. Without loss of generality, other well-known criteria or methods to compute the matrix coefficients can be used similarly to replace or augment the minimum mean-square error principle. For example, the matrix coefficients can be computed using higher-order error terms, or by minimization of an L1 norm (e.g., least absolute deviation criterion). Furthermore various methods can be employed including non-negative factorization or optimization techniques, non-parametric estimators, maximum-likelihood estimators, and alike. Additionally, the matrix coefficients may be computed using iterative or gradient-descent processes, interpolation methods, heuristic methods, dynamic programming, machine learning, fuzzy optimization, simulated annealing, or closed-form solutions, and analysis-by-synthesis techniques may be used. Last but not least, the matrix coefficient estimation may be constrained in various ways, for example by limiting the range of values, regularization terms, superposition of energy-preservation requirements and alike.

In practical situations, the HRIR or BRIR $h_{l,i}$, $h_{r,i}$ will involve frequency-dependent delays and/or phase shifts. Accordingly, the coefficients w may be complex-valued with an imaginary component substantially different from zero.

One form of implementation of the processing of this embodiment is shown in FIG. 1. Audio content 41 is processed by a hybrid complex quadrature mirror filter (HCQMF) analysis bank 42 into sub-band signals. Subsequently, HRIRs 44 are applied 43 to the filter bank outputs to generate binaural signals Y. In parallel, the inputs are rendered 45 for loudspeaker playback resulting in loudspeaker signals Z. Additionally, the coefficients (or weights) w are calculated 46 from the loudspeaker and binaural signals Y and Z and included in the core coder bitstream 48. Different core coders can be used, such as MPEG-1 Layer 1, 2, and 3, e.g. as disclosed in Brandenburg, K., & Bosi, M. (1997). "Overview of MPEG audio: Current and future standards for low bit-rate audio coding". Journal of the Audio Engineering Society, 45(1/2), 4-21 or Riedmiller, J., Mehta, S., Tsingos, N., & Boon, P. (2015). "Immersive and Personalized Audio: A Practical System for Enabling Interchange, Distribution, and Delivery of Next-Generation Audio Experiences". Motion Imaging Journal, SMPTE, 124(5), 1-23, both hereby incorporated by reference. If the core coder is not able to use sub-band signals as input, the sub-band signals may first be converted to the time domain using a hybrid complex quadrature mirror filter (HCQMF) synthesis filter bank 47.

On the decoding side, if the decoder is configured for headphone playback, the coefficients are extracted 49 and applied 50 to the core decoder signals prior to HCQMF synthesis 51 and reproduction 52. An optional HCQMF analysis filter bank 54 may be required as indicated in FIG. 1 if the core coder does not produce signals in the HCQMF domain. In summary, the signals encoded by the core coder are intended for loudspeaker playback, while loudspeaker-to-binaural coefficients are determined in the encoder, and applied in the decoder. The decoder may further be equipped with a user override functionality, so that in headphone playback mode, the user may select to playback over headphones the conventional loudspeaker signals rather than the binaurally processed signals. In this case, the weights are ignored by the decoder. Finally, when the decoder is configured for loudspeaker playback, the weights may be ignored, and the core decoder signals may be played back over a loudspeaker reproduction system, either directly, or after upmixing or downmixing to match the layout of loudspeaker reproduction system.

It will be evident that the methods described in the previous paragraphs are not limited to using a quadrature mirror filter banks; as other filter bank structures or transforms can be used equally well, such as a short-term windowed discrete Fourier transforms.

This scheme has various benefits compared to conventional approaches. These can include: 1) The decoder complexity is only marginally higher than the complexity for plain stereo playback, as the addition in the decoder consists of a simple (time and frequency-dependent) matrix only, controlled by bit stream information. 2) The approach is suitable for channel-based and object-based content, and does not depend on the number of objects or channels present in the content. 3) The HRTFs become encoder tuning parameters, i.e. they can be modified, improved, altered or adapted at any time without regard for decoder compatibility. With decoders present in the field, HRTFs can still be optimized or customized without needing to modify decoder-side processing stages. 4) The bit rate is very low compared to bit rates required for multi-channel or object-based content, because only a few loudspeaker signals (typically one or two) need to be conveyed from encoder to decoder with additional (low-rate) data for the coefficients w. 5) The same bit stream can be faithfully reproduced on loudspeakers and headphones. 6) A bit stream may be constructed in a scalable manner; if, in a specific service context, the end point is guaranteed to use loudspeakers only, the transformation coefficients w may be stripped from the bit stream without consequences for the conventional loudspeaker presentation. 7) Advanced codec features operating on loudspeaker presentations, such as loudness management, dialog enhancement, etcetera, will continue to work as intended (when playback is over loudspeakers). 8) Loudness for the binaural presentation can be handled independently from the loudness of loudspeaker playback by scaling of the coefficients w. 9) Listeners using headphones can choose to listen to a binaural or conventional stereo presentation, instead of being forced to listen to one or the other.

Extension with Early Reflections

It is often desirable to include one or more early reflections in a binaural rendering that are the result of the presence of a floor, walls, or ceiling to increase the realism of a binaural presentation. If a reflection is of a specular nature, it can be interpreted as a binaural presentation in itself, in which the corresponding HRIRs include the effect of surface absorption, an increase in the delay, and a lower overall level due to the increased acoustical path length from sound source to the ear drums.

Figure 2:
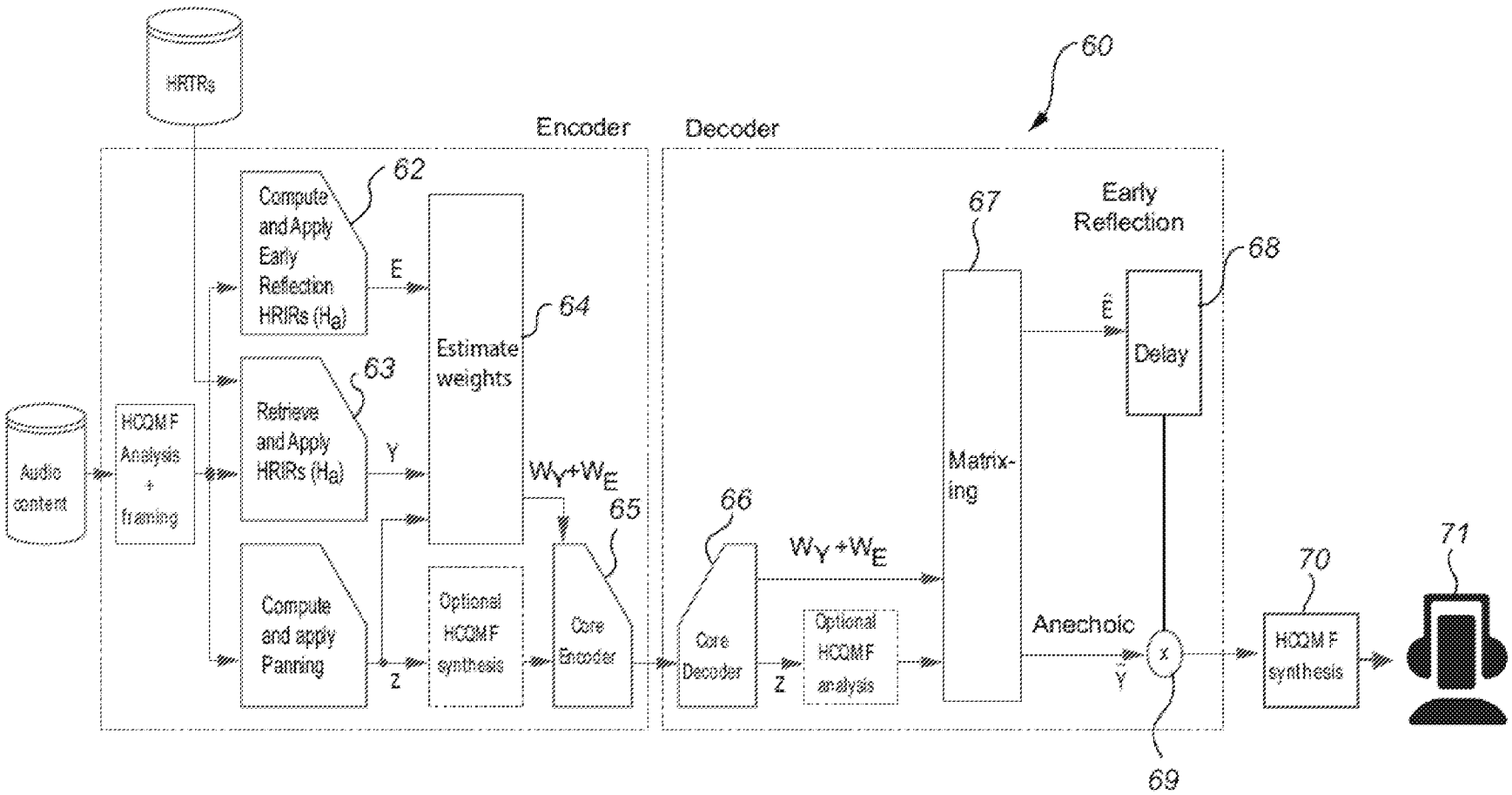
FIG. 2 illustrates schematically the coefficients W ($W_E$) used to reconstruct the anechoic signal and one early reflection (with an additional bulk delay stage) from the core decoder output according to one example.

These properties can be captured with a modified arrangement such as that illustrated in FIG. 2, which is a modification on the arrangement of FIG. 1. In the encoder 64, coefficients W are determined for (1) reconstruction of the anechoic binaural presentation from a loudspeaker presentation (coefficients $W_Y$), and (2) reconstruction of a binaural presentation of a reflection from a loudspeaker presentation (coefficients $W_E$). In this case, the anechoic binaural presentation is determined by binaural rendering HRIRs $H_a$ resulting in anechoic binaural signal pair Y, while the early reflection is determined by HRIRs $H_e$ resulting in early reflection signal pair E. To allow the parametric reconstruction of the early reflection from the stereo mix, it is important that the delay due to the longer path length of the early reflection is removed from the HRIRs $H_e$ in the encoder, and that this particular delay is applied in the decoder.

The decoder will generate the anechoic signal pair and the early reflection signal pair by applying coefficients W ($W_Y$; $W_E$) to the loudspeaker signals. The early reflection is subsequently processed by a delay stage 68 to simulate the longer path length for the early reflection. The delay parameter of the block 68 can be included in the coder bit stream, or can be a user-defined parameter, or can be made dependent on the simulated acoustic environment, or can be made dependent on the actual acoustic environment the listener is in.

Extension with Late Reverberation

To include the simulation of late reverberation in the binaural presentation, a late-reverberation algorithm can be employed, such as a feedback-delay network (FDN). An FDN takes as input one or more objects and or channels, and produces (in case of a binaural reverberator) two late reverberation signals. In a conventional algorithm, the decoder output (or a downmix thereof) can be used as input to the FDN. This approach has a significant disadvantage. In many use cases, it can be desirable to adjust the amount of late reverberation on a per-object basis. For example, dialog clarity is improved if the amount of late reverberation is reduced.

In an alternative embodiment per-object or per-channel control of the amount of reverberation can be provided in the same way as anechoic or early-reflection binaural presentations are constructed from a stereo mix.

Figure 3:
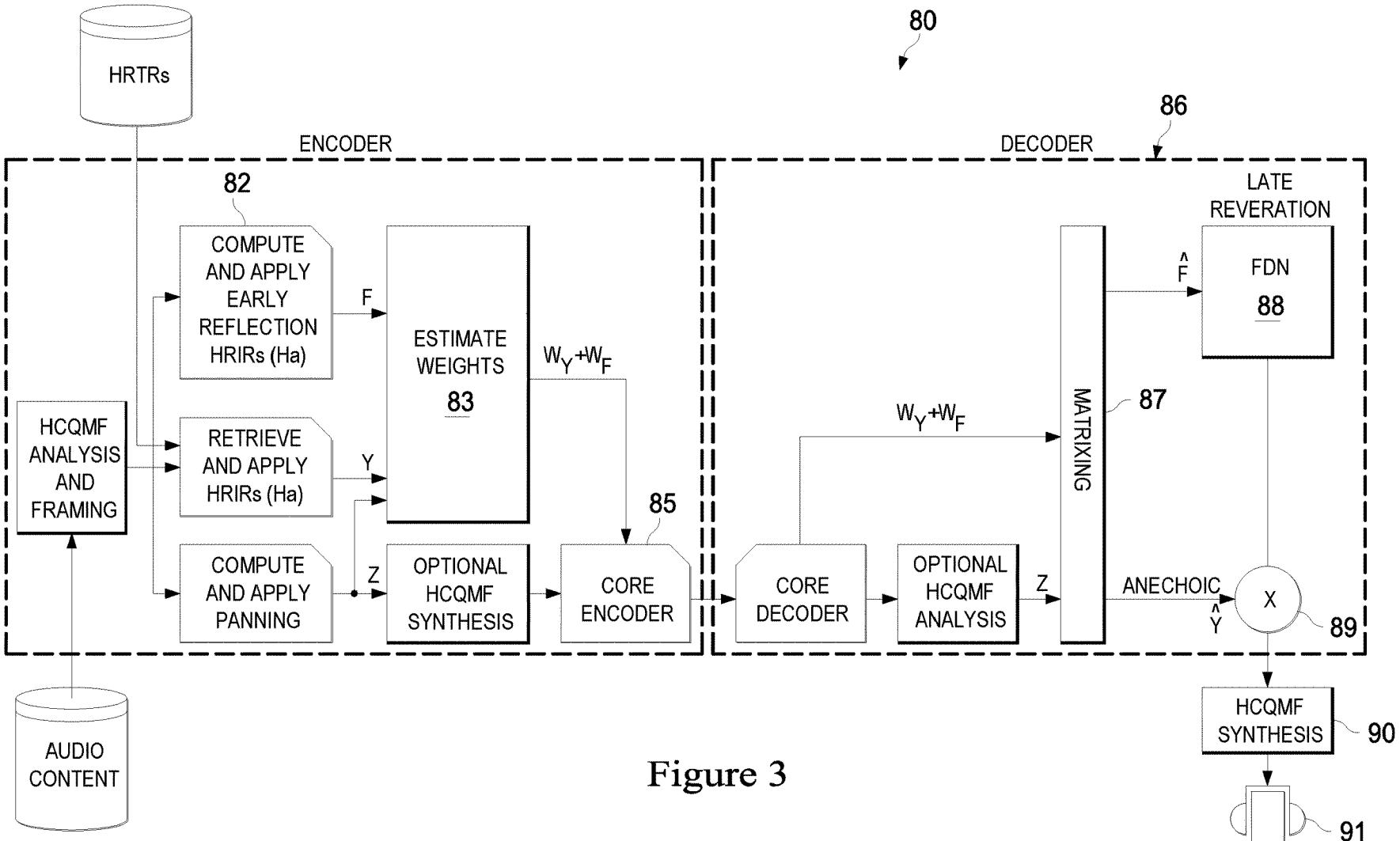
FIG. 3 illustrates schematically a process of using the coefficients W ($W_F$) used to reconstruct the anechoic signal and an FDN input signal from the core decoder output according to one example.

As illustrated in FIG. 3, various modifications to the previous arrangements can be made to accommodate further late reverberation. In the encoder 81, an FDN input signal F is computed 82 that can be a weighted combination of inputs. These weights can be dependent on the content, for example as a result of manual labelling during content creation or automatic classification through media intelligence algorithms. The FDN input signal itself is discarded by weight estimation unit 83, but coefficient data $W_F$ that allow estimation, reconstruction or approximation of the FUN input signal from the loudspeaker presentation are included 85 in the bit stream. In the decoder 86, the FUN input signal is reconstructed 88, processed by the FDN itself, and included 89 in the binaural output signal for listener 91.

Additionally, an FDN may be constructed such that, multiple (two or more) inputs are allowed so that spatial qualities of the input signals are preserved at the FDN output. In such cases, coefficient data that allow estimation of each FDN input signal from the loudspeaker presentation are included in the bitstream.

In this case it may be desirable to control the spatial positioning of the object and or channel in respect to the FUN inputs.

In some cases, it may be possible to generate late reverberation simulation (e.g., FDN) input signals in response to parameters present in a data stream for a separate purpose (e.g., parameters not specifically intended to be applied to base signals to generate PDN input signals). For instance, in one exemplary dialog enhancement system, a dialog signal is reconstructed from a set of base signals by applying dialog enhancement parameters to the base signals. The dialog signal is then enhanced (e.g., amplified) and mixed back into the base signals (thus, amplifying the dialog components relative to the remaining components of the base signals). As described above, it is often desirable to construct the FDN input signal such that it does not contain dialog components. Thus, in systems for which dialog enhancement parameters are already available, it is possible to reconstruct the desired dialog free (or, at least, dialog reduced) FDN input signal by first reconstructing the dialog signal from the base signal and the dialog enhancement parameters, and then subtracting (e.g., cancelling) the dialog signal from the base signals. In such a system, dedicated parameters for reconstructing the FDN input signal from the base signals may not be necessary (as the dialog enhancement parameters may be used instead), and thus may be excluded, resulting in a reduction in the required parameter data rate without loss of functionality.

Combining Early Reflections and Late Reverberation

Although extensions of anechoic presentation with early reflection(s) and late reverberation are denoted independently in the previous sections, combinations are possible as well. For example, a system may include: 1) Coefficients $W_Y$ to determine an anechoic presentation from a loudspeaker presentation; 2) Additional coefficients $W_E$ to determine a certain number of early reflections from a loudspeaker presentation; 3) Additional coefficients $W_F$ to determine one or more late-reverberation input signals from a loudspeaker presentation, allowing to control the amount of late reverberation on a per-object basis.

Anechoic Rendering as First Presentation

Figure 4:
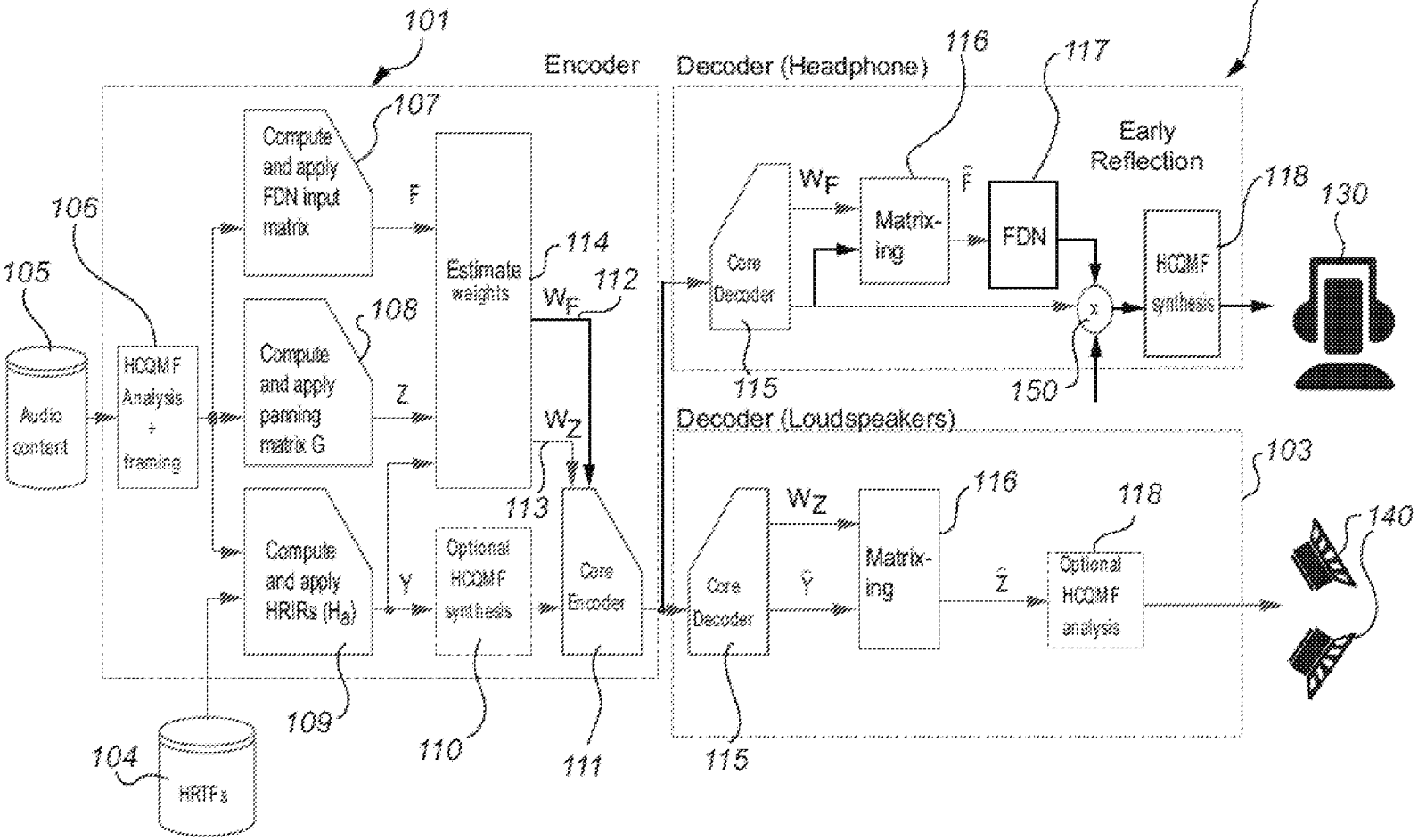
FIG. 4 illustrates schematically the production and processing of coefficients w to process an anechoic presentation for headphones and loudspeakers according to one example.

Although the use of a loudspeaker presentation as a first presentation to be encoded by a core coder has the advantage of providing backward compatibility with decoders that cannot interpret or process the transformation data w, the first presentation is not limited to a presentation for loudspeaker playback. FIG. 4 shows a schematic overview of a method for encoding and decoding audio content 105 for reproduction on headphones 130 or loudspeakers 140. The encoder 101 takes the input audio content 105 and processes these signals by HCQMF filterbank 106. Subsequently, an anechoic presentation Y is generated by HRIR convolution element 109 based on an HRIR/HRTF database 104. Additionally, a loudspeaker presentation Z is produced by element 108 which computes and applies a loudspeaker panning matrix G. Furthermore, element 107 produces an FDN input mix F.

The anechoic signal Y is optionally converted to the time domain using HCQMF synthesis filterbank 110, and encoded by core encoder 111. The transformation estimation block 114 computes parameters $W_F$ (112) that allow reconstruction of the FDN input signal F from the anechoic presentation Y, as well as parameters $W_Z$ (113) to reconstruct the loudspeaker presentation Z from the anechoic presentation Y. Parameters 112 and 113 are both included in the core coder bit stream. Alternatively, or in addition, although not shown in FIG. 4, transformation estimation block may compute parameters $W_E$ that allow reconstruction of an early reflection signal E from the anechoic presentation Y.

The decoder has two operation modes, visualized by decoder mode 102 intended for headphone listening 130, and decoder mode 103 intended for loudspeaker playback 140. In the case of headphone playback, core decoder 115 decodes the anechoic presentation Y and decodes transformation parameters $W_F$. Subsequently, the transformation parameters $W_F$ are applied to the anechoic presentation Y by matrixing block 116 to produce an estimated FDN input signal, which is subsequently processed by PUN 117 to produce a late reverberation signal. This late reverberation signal is mixed with the anechoic presentation Y by adder 150, followed by HCQMF synthesis filterbank 118 to produce the headphone presentation 130. If parameters $W_E$ are also present, the decoder may apply these parameters to the anechoic presentation Y to produce an estimated early reflection signal, which is subsequently processed through a delay and mixed with the anechoic presentation Y.

In the case of loudspeaker playback, the decoder operates in mode 103, in which core decoder 115 decodes the anechoic presentation Y, as well as parameters $W_Z$. Subsequently, matrixing stage 116 applies the parameters $W_Z$ onto the anechoic presentation Y to produce an estimate or approximation of the loudspeaker presentation Z. Lastly, the signal is converted to the time domain by HCQMF synthesis filterbank 118 and produced by loudspeakers 140.

Finally, it should be noted that the system of FIG. 4 may optionally be operated without determining and transmitting parameters $W_Z$. In this mode of operation, it is not possible to generate the loudspeaker presentation Z from the anechoic presentation Y. However, because parameters $W_E$ and/or $W_F$ are determined and transmitted, it is possible to generate a headphone presentation including early reflection and/or late reverberation components from the anechoic presentation.

Cross-Talk Cancellation

Figure 5:
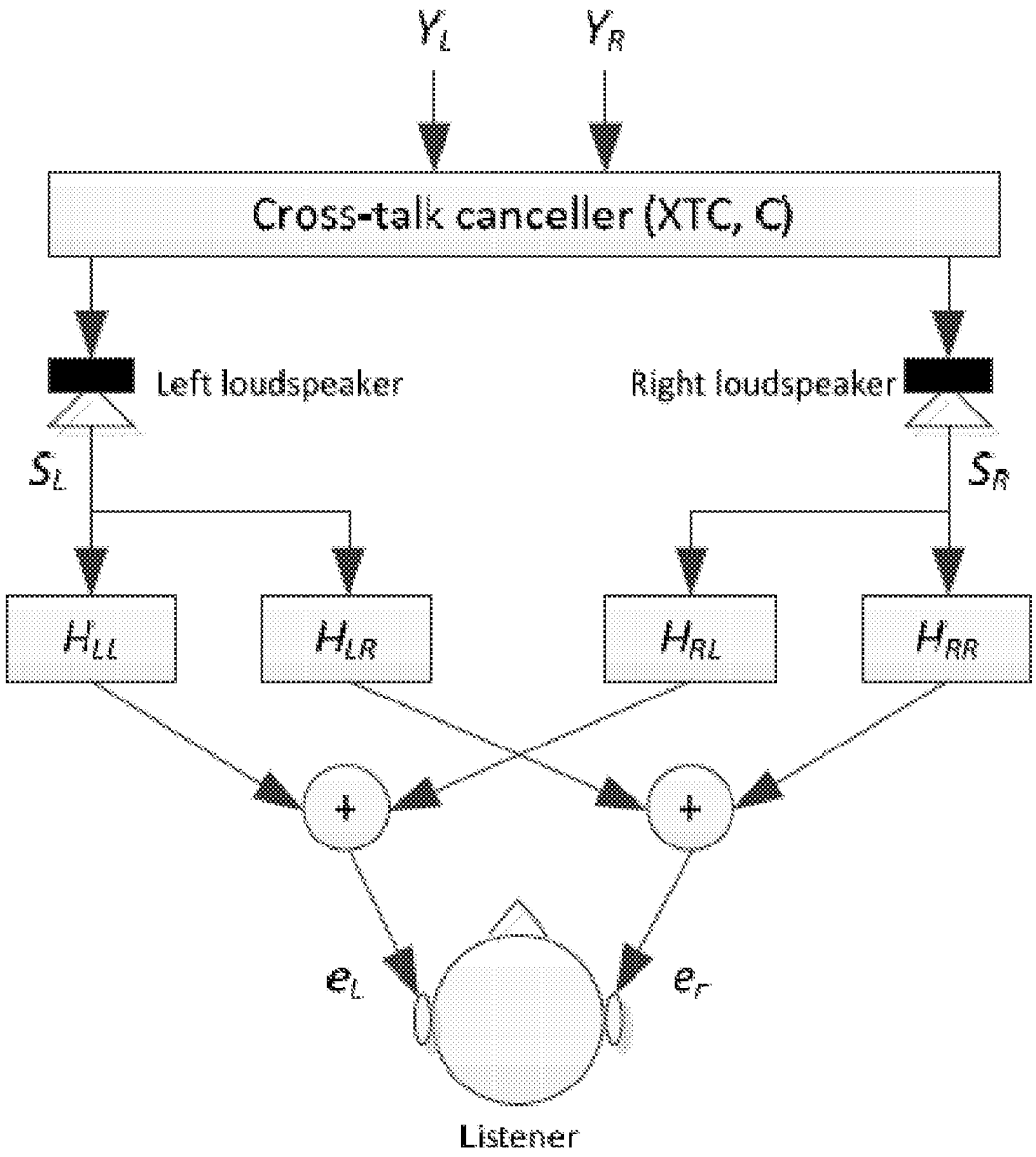
FIG. 5 illustrates an example of a design of a cross-talk canceller that is based on a model of audio transmission from loudspeakers to a listener's ears.

The systems of FIGS. 1-4 and Dolby's AC-4 Immersive Stereo can produce both a stereo loudspeaker and binaural headphones representation. According to some implementations, the stereo loudspeaker representation may be intended for playback on high-quality (HiFi) loudspeaker setups where the loudspeakers are ideally placed at azimuth angles of approximately +/−30 to 45 degrees relative to the listener position. Such loudspeaker layout allows objects and beds to be reproduced on a horizontal arc between the left and right loudspeaker. Consequently, the front/back and elevation dimensions are essentially absent in such presentation. Moreover, if audio is reproduced on a television or mobile device (such as a phone, tablet, or laptop), the azimuth angles of the loudspeakers may be smaller than 30 degrees which reduces the spatial extent of the reproduced presentation even further. A technique to overcome the small azimuth coverage is to employ the concept of cross-talk cancellation. The theory and history of such rendering is discussed in publication Gardner, W. "3-D Audio Using Loudspeakers", Kluwer Academic, 1998. FIG. 5 illustrates an example of a design of a cross-talk canceller that is based on a model of audio transmission from loudspeakers to a listener's ears. Signals $s_L$ and $s_R$ represent the signals sent from the left and right loudspeakers, and signals $e_L$ and $e_R$ represent the signals arriving at the left and right ears of the listener. The input signals to the cross-talk cancellation stage (XTC, C) are denoted by $y_L$, $y_R$. Each ear signal $e_L$, $e_R$ is modeled as the sum of the left and right loudspeaker signals each filtered by a separate linear time-invariant transfer function H modeling the acoustic transmission from each speaker to that ear. These four transfer functions are usually modeled using head related transfer functions (HRTFs) selected as a function of an assumed speaker placement with respect to the listener. The crosstalk-cancellation stage is designed such that the signals arriving at the ear drums $e_L$, $e_R$ are equal or close to the input signals $y_L$, $y_R$.

The model depicted in FIG. 5 can be written in matrix equation form as follows:

$$\begin{bmatrix} e_L \\ e_R \end{bmatrix} = \begin{bmatrix} H_{LL} & H_{RL} \\ H_{LR} & H_{RR} \end{bmatrix} \begin{bmatrix} s_L \\ s_R \end{bmatrix} \text{ or } e = Hs \qquad \text{Equation No. (14)}$$

Equation 14 reflects the relationship between signals at one particular frequency and is meant to apply to the entire frequency range of interest, and the same applies to subsequent related equations. A crosstalk canceller matrix C may be realized by inverting the matrix H, as shown in Equation 15:

$$C = H^{-1} = \frac{1}{H_{LL}H_{RR} - H_{LR}H_{RL}} \begin{bmatrix} H_{RR} & -H_{RL} \\ -H_{LR} & H_{LL} \end{bmatrix} \qquad \text{Equation No. (15)}$$

Given left and right binaural signals $b_L$ and $b_R$, the speaker signals $s_L$ and $s_R$ are computed as the binaural signals multiplied by the crosstalk canceller matrix:

$$s = Cb \text{ where } b = \begin{bmatrix} b_L \\ b_R \end{bmatrix} \qquad \text{Equation No. (16)}$$

Substituting Equation 16 into Equation 14 and noting that $C = H^{-1}$ yields:

$e = HCb = b$ Equation No. (17)

In other words, generating speaker signals by applying the crosstalk canceller to the binaural signal yields signals at the ears of the listener equal to the binaural signal. This assumes that the matrix H perfectly models the physical acoustic transmission of audio from the speakers to the listener's ears. In reality, this will likely not be the case, and therefore Equation 17 will generally be approximated. In practice, however, this approximation is usually close enough that a listener will substantially perceive the spatial impression intended by the binaural signal b.

The binaural signal b is often synthesized from a monaural audio object signal o through the application of binaural rendering filters $B_L$ and $B_R$:

$$\begin{bmatrix} b_L \\ b_R \end{bmatrix} = \begin{bmatrix} B_L \\ B_R \end{bmatrix} o \text{ or } b = Bo \qquad \text{Equation No. (18)}$$

The rendering filter pair B is most often given by a pair of HRTFs chosen to impart the impression of the object signal o emanating from an associated position in space relative to the listener. In equation form, this relationship may be represented as:

$$B = \text{HRTF}\{\text{pos}(o)\} \qquad \text{Equation No. (19)}$$

In Equation 19 above, pos(o) represents the desired position of object signal o in 3D space relative to the listener. This position may be represented in Cartesian (x,y,z) coordinates or any other equivalent coordinate system such a polar system. This position might also be varying in time in order to simulate movement of the object through space. The function HRTF{ } is meant to represent a set of HRTFs addressable by position. Many such sets measured from human subjects in a laboratory exist, such as the CIPIC database, which is a public-domain database of high-spatial-resolution HRTF measurements for a number of different subjects. Alternatively, the set might be comprised of a parametric model such as the spherical head model. In a practical implementation, the HRTFs used for constructing the crosstalk canceller are often chosen from the same set used to generate the binaural signal, though this is not a requirement.

In many applications, a multitude of objects at various positions in space are simultaneously rendered. In such a case, the binaural signal is given by a sum of object signals with their associated HRTFs applied:

$$b = \sum_{i=1}^{N} B_i o_i \text{ where } B_i = HRTF\{pos(o_i)\} \qquad \text{Equation No. (20)}$$

With this multi-object binaural signal, the entire rendering chain to generate the speaker signals is given by:

$$s = C\sum_{i=1}^{N} B_i o_i \quad \text{Equation No. (21)}$$

In many applications, the object signals $o_i$ are given by the individual channels of a multichannel signal, such as a 5.1 signal comprised of left, center, right, left surround, and right surround. In this case, the HRTFs associated with each object may be chosen to correspond to the fixed speaker positions associated with each channel. In this way, a 5.1 surround system may be virtualized over a set of stereo loudspeakers. In other applications the objects may be sources allowed to move freely anywhere in 3D space. In the case of a next generation spatial audio format, the set of objects in Equation 8 may consist of both freely moving objects and fixed channels.

One disadvantage of a virtual spatial audio rendering processor is that the effect is highly dependent on the listener sitting in the optimal position with respect to the speakers that is assumed in the design of the crosstalk canceller. Some alternative cross-talk cancellation methods will now be described with reference to FIGS. 6-12.

Figure 6:
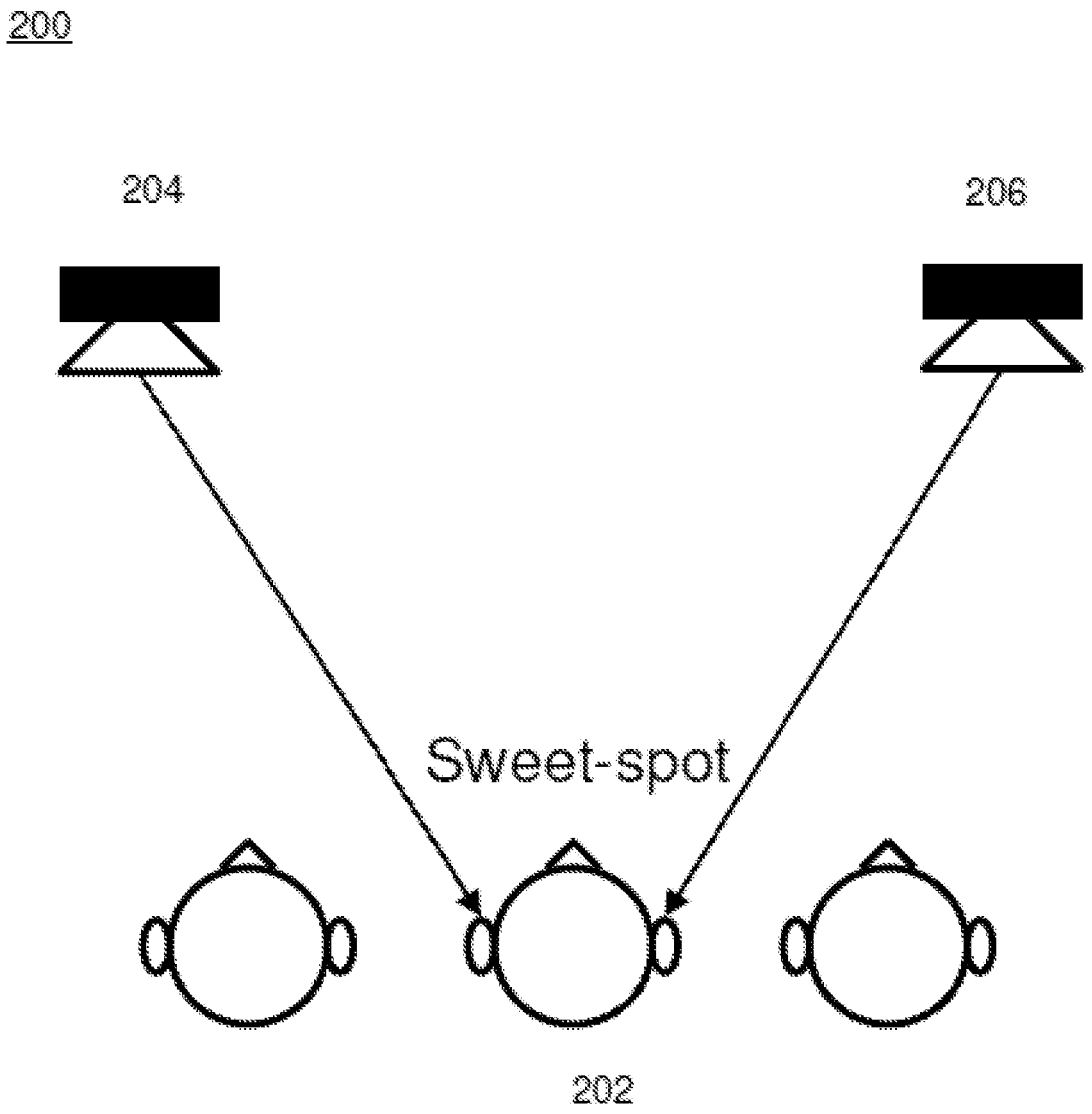
FIG. 6 shows an example of three listeners sitting on a couch.

Embodiments are meant to address a general limitation of known virtual audio rendering processes with regard to the fact that the effect is highly dependent on the listener being located in the position with respect to the speakers that is assumed in the design of the crosstalk canceller. If the listener is not in this optimal listening location (the so-called "sweet spot"), then the crosstalk cancellation effect may be compromised, either partially or totally, and the spatial impression intended by the binaural signal is not perceived by the listener. This is particularly problematic for multiple listeners in which case only one of the listeners can effectively occupy the sweet spot. For example, with three listeners sitting on a couch, as depicted in FIG. 6, only the center listener 202 of the three will likely enjoy the full benefits of the virtual spatial rendering played back by speakers 204 and 206, since only that listener is in the crosstalk canceller's sweet spot. Embodiments are thus directed to improving the experience for listeners outside of the optimal location while at the same time maintaining or possibly enhancing the experience for the listener in the optimal location.

Diagram 200 illustrates the creation of a sweet spot location 202 as generated with a crosstalk canceller. It should be noted that application of the crosstalk canceller to the binaural signal described by Equation 16 and of the binaural filters to the object signals described by Equations 18 and 20 may be implemented directly as matrix multiplication in the frequency domain. However, equivalent application may be achieved in the time domain through convolution with appropriate FIR (finite impulse response) or IIR (infinite impulse response) filters arranged in a variety of topologies. Embodiments include all such variations.

In spatial audio reproduction, the sweet spot 202 may be extended to more than one listener by utilizing more than two speakers. This is most often achieved by surrounding a larger sweet spot with more than two speakers, as with a 5.1 surround system. In such systems, sounds intended to be heard from behind the listener(s), for example, are generated by speakers physically located behind them, and as such, all of the listeners perceive these sounds as coming from behind. With virtual spatial rendering over stereo speakers, on the other hand, perception of audio from behind is controlled by the HRTFs used to generated the binaural signal and will only be perceived properly by the listener in the sweet spot 202. Listeners outside of the sweet spot will likely perceive the audio as emanating from the stereo speakers in front of them. Despite their benefits, installation of such surround systems is not practical for many consumers. In certain cases, consumers may prefer to keep all speakers located at the front of the listening environment, oftentimes collocated with a television display. In other cases, space or equipment availability may be constrained.

Embodiments are directed to the use of multiple speaker pairs in conjunction with virtual spatial rendering in a way that combines benefits of using more than two speakers for listeners outside of the sweet spot and maintaining or enhancing the experience for listeners inside of the sweet spot in a manner that allows all utilized speaker pairs to be substantially collocated, though such collocation is not required. A virtual spatial rendering method is extended to multiple pairs of loudspeakers by panning the binaural signal generated from each audio object between multiple crosstalk cancellers. The panning between crosstalk cancellers is controlled by the position associated with each audio object, the same position utilized for selecting the binaural filter pair associated with each object. The multiple crosstalk cancellers are designed for and feed into a corresponding multitude of speaker pairs, each with a different physical location and/or orientation with respect to the intended listening position.

As described above, with a multi-object binaural signal, the entire rendering chain to generate speaker signals is given by the summation expression of Equation 21. The expression may be described by the following extension of Equation 21 to M pairs of speakers:

$$s_j = C_j\sum_{i=1}^{N} \alpha_{ij} B_i o_i,\ j = 1 \ldots M,\ M > 1 \quad \text{Equation No. (22)}$$

In the above Equation 22, the variables have the following assignments:

$o_i$=audio signal for the ith object out of N $B_i$=binaural filter pair for the ith object given by $B_i$=HRTF{pos($o_i$)}

$\alpha_{ij}$=panning coefficient for the ith object into the jth crosstalk canceller $C_j$=crosstalk canceller matrix for the jth speaker pair $s_j$=stereo speaker signal sent to the jth speaker pair The M panning coefficients associated with each object i are computed using a panning function which takes as input the possibly time-varying position of the object:

$$\begin{bmatrix} \alpha_{1i} \\ \vdots \\ \alpha_{Mi} \end{bmatrix} = Panner\{pos(o_i)\} \quad \text{Equation No. (23)}$$

Figure 7:
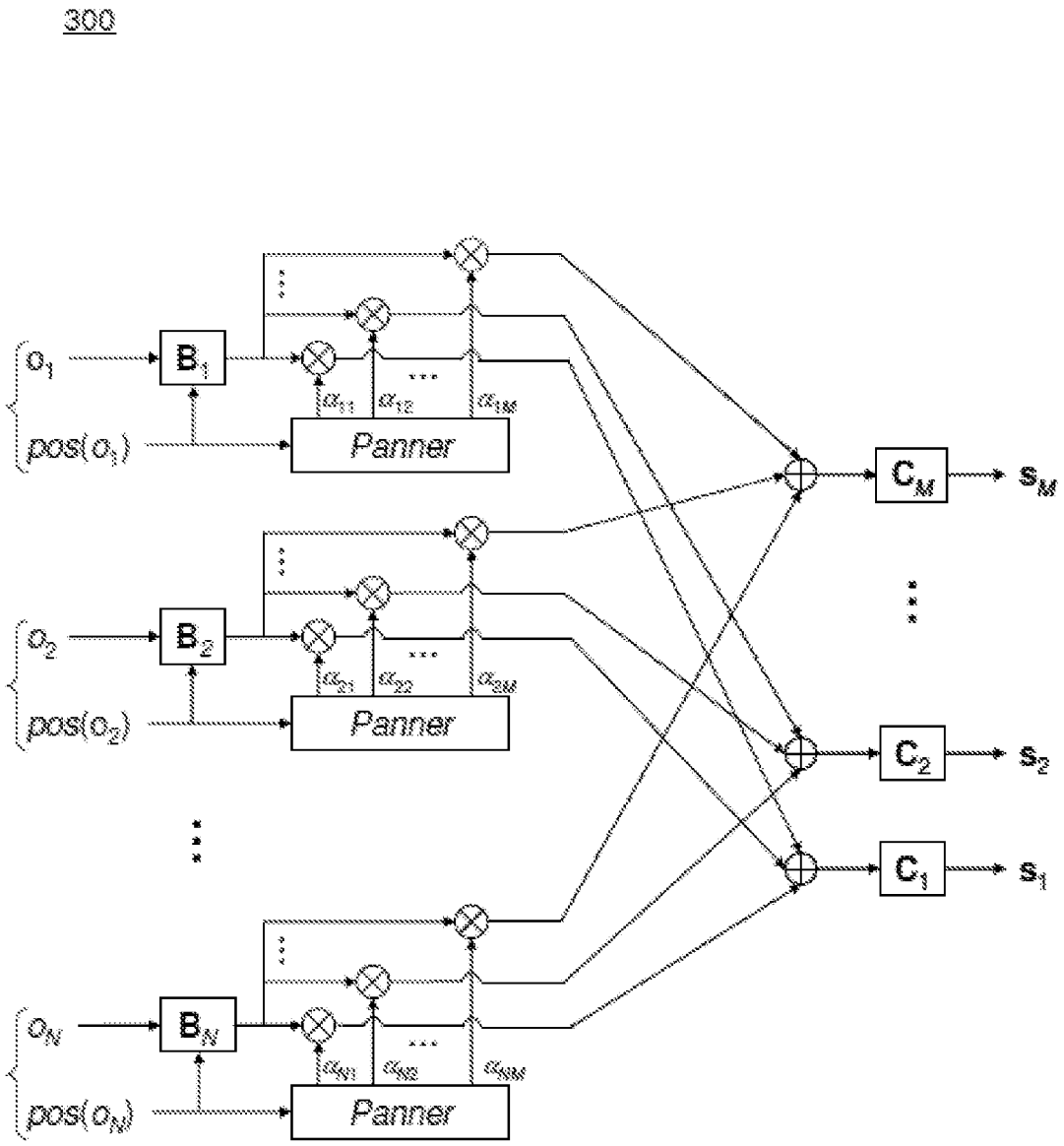
FIG. 7 illustrates a system for panning a binaural signal generated from audio objects between multiple crosstalk cancellers according to one example.
Figure 8:
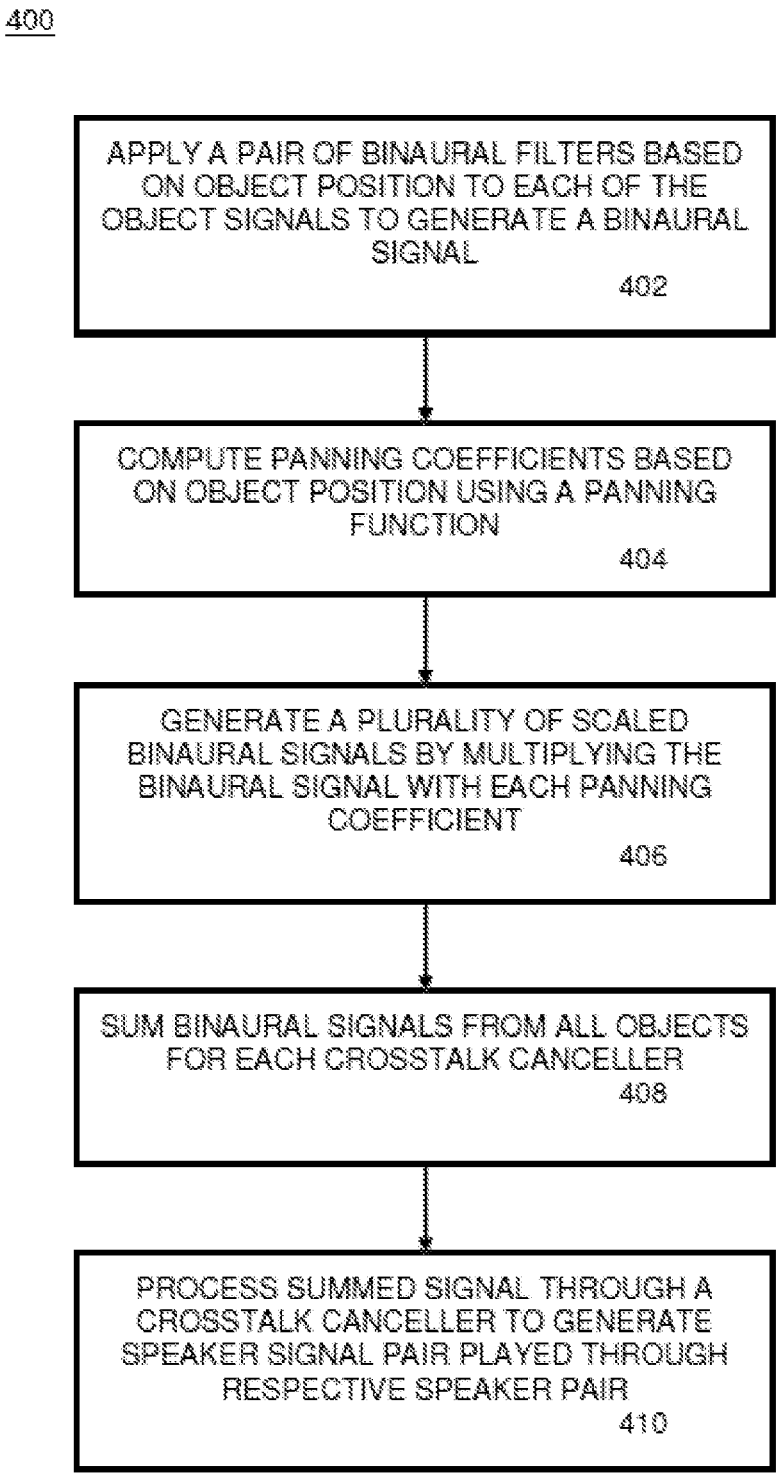
FIG. 8 is a flowchart that illustrates a method of panning the binaural signal between the multiple crosstalk cancellers, according to one embodiment.

Equations 22 and 23 are equivalently represented by the block diagram depicted in FIG. 7. FIG. 7 illustrates a system for panning a binaural signal generated from audio objects between multiple crosstalk cancellers according to one example. FIG. 8 is a flowchart that illustrates a method of panning the binaural signal between the multiple crosstalk cancellers, according to one embodiment. As shown in diagrams 300 and 400, for each of the N object signals $o_i$, a pair of binaural filters $B_i$, selected as a function of the object position pos($o_i$), is first applied to generate a binaural signal, step 402. Simultaneously, a panning function computes M panning coefficients, $a_{i1} \ldots a_{iM}$, based on the object position $pos(o_i)$, step 404. Each panning coefficient separately multiplies the binaural signal generating M scaled binaural signals, step 406. For each of the M crosstalk cancellers, $C_1$, the jth scaled binaural signals from all N objects are summed, step 408. This summed signal is then processed by the crosstalk canceller to generate the jth speaker signal pair $s_j$, which is played back through the jth loudspeaker pair, step 410. It should be noted that the order of steps illustrated in FIG. 8 is not strictly fixed to the sequence shown, and some of the illustrated steps or acts may be performed before or after other steps in a sequence different to that of process 400.

In order to extend the benefits of the multiple loudspeaker pairs to listeners outside of the sweet spot, the panning function distributes the object signals to speaker pairs in a manner that helps convey desired physical position of the object (as intended by the mixer or content creator) to these listeners. For example, if the object is meant to be heard from overhead, then the panner pans the object to the speaker pair that most effectively reproduces a sense of height for all listeners. If the object is meant to be heard to the side, the panner pans the object to the pair of speakers that most effectively reproduces a sense of width for all listeners. More generally, the panning function compares the desired spatial position of each object with the spatial reproduction capabilities of each speaker pair in order to compute an optimal set of panning coefficients.

Figure 9:
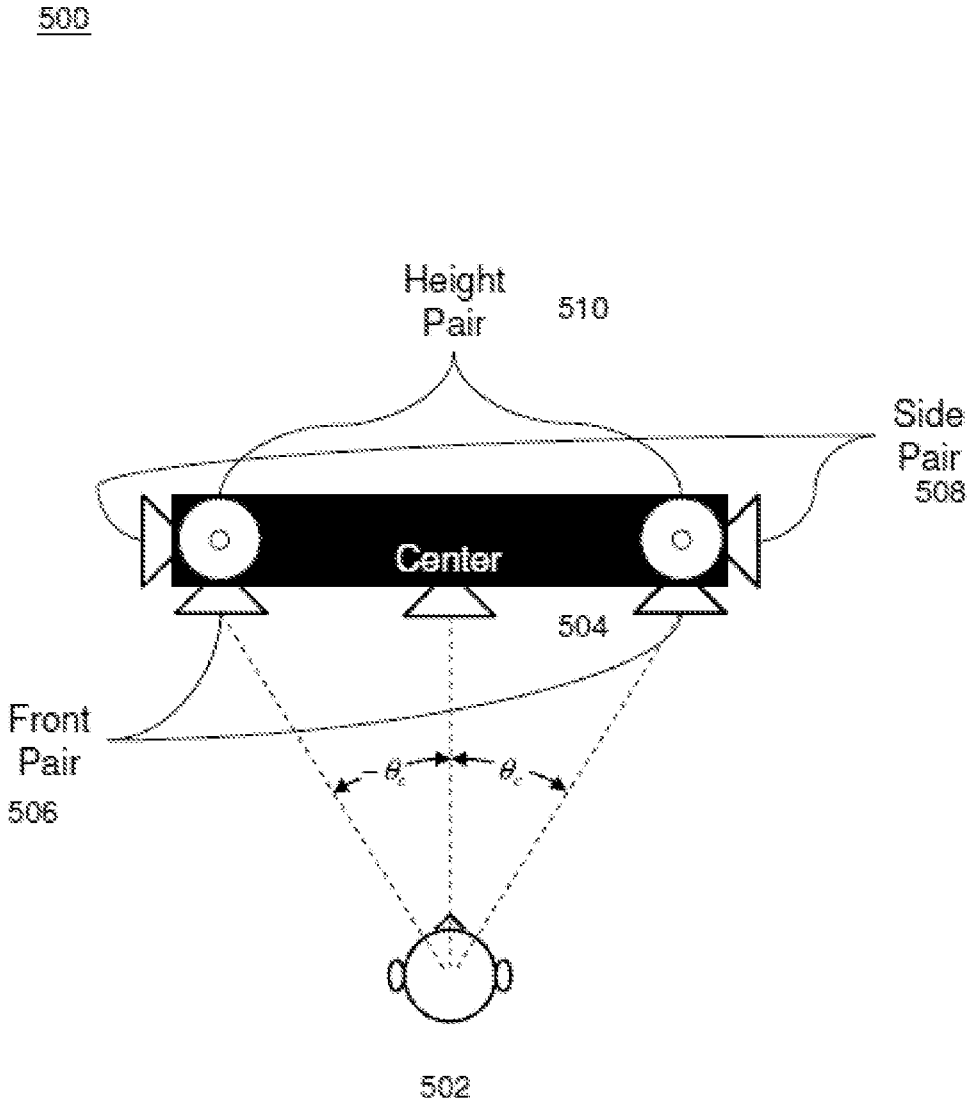
FIG. 9 shows an example of three speaker pairs in front of a listener.

In general, any practical number of speaker pairs may be used in any appropriate array. In a typical implementation, three speaker pairs may be utilized in an array that are all collocated in front of the listener as shown in FIG. 9. As shown in diagram 500, a listener 502 is placed in a location relative to speaker array 504. The array comprises a number of drivers that project sound in a particular direction relative to an axis of the array. For example, as shown in FIG. 9, a first driver pair 506 points to the front toward the listener (front-firing drivers), a second pair 508 points to the side (side-firing drivers), and a third pair 510 points upward (upward-firing drivers). These pairs are labeled, Front 506, Side 508, and Height 510 and associated with each are cross-talk cancellers $C_F$, $C_S$, and $C_H$, respectively.

For both the generation of the cross-talk cancellers associated with each of the speaker pairs, as well as the binaural filters for each audio object, parametric spherical head model HRTFs are utilized. In an embodiment, such parametric spherical head model HRTFs may be generated as described in U.S. patent application Ser. No. 13/132,570 (Publication No. US 2011/0243338) entitled "Surround Sound Virtualizer and Method with Dynamic Range Compression," which is hereby incorporated by reference. In general, these HRTFs are dependent only on the angle of an object with respect to the median plane of the listener. As shown in FIG. 9, the angle at this median plane is defined to be zero degrees with angles to the left defined as negative and angles to the right as positive.

For the speaker layout shown in FIG. 9, it is assumed that the speaker angle $\theta_C$ is the same for all three speaker pairs, and therefore the crosstalk canceller matrix C is the same for all three pairs. If each pair was not at approximately the same position, the angle could be set differently for each pair. Letting $HRTF_L\{\theta\}$ and $HRTF_R\{\theta\}$ define the left and right parametric HRTF filters associated with an audio source at angle θ, the four elements of the cross-talk canceller matrix as defined in Equation 15 are given by:

$$H_{LL}=HRTF_L\{-\theta_C\} \quad \text{Equation No. (24a)}$$

$$H_{LR}=HRTF_R\{-\theta_C\} \quad \text{Equation No. (24b)}$$

$$H_{RL}=HRTF_L\{\theta_C\} \quad \text{Equation No. (24c)}$$

$$H_{RR}=HRTF_R\{\theta_C\} \quad \text{Equation No. (24d)}$$

Associated with each audio object signal $o_i$ is a possibly time-varying position given in Cartesian coordinates $\{x_i\ y_i\ z_i\}$. Since the parametric HRTFs employed in the preferred embodiment do not contain any elevation cues, only the x and y coordinates of the object position are utilized in computing the binaural filter pair from the HRTF function. These $\{x_i\ y_i\}$ coordinates are transformed into equivalent radius and angle $\{r_i\ \theta_i\}$, where the radius is normalized to lie between zero and one. In an embodiment, the parametric HRTF does not depend on distance from the listener, and therefore the radius is incorporated into computation of the left and right binaural filters as follows:

$$B_L=(1-\sqrt{r_i})+\sqrt{r_i}HRTF_L\{\theta_i\} \quad \text{Equation No. (25a)}$$

$$B_R=(1-\sqrt{r_i})+\sqrt{r_i}HRTF_R\{\theta_i\} \quad \text{Equation No. (25b)}$$

When the radius is zero, the binaural filters are simply unity across all frequencies, and the listener hears the object signal equally at both ears. This corresponds to the case when the object position is located exactly within the listener's head. When the radius is one, the filters are equal to the parametric HRTFs defined at angle $\theta_i$. Taking the square root of the radius term biases this interpolation of the filters toward the HRTF that better preserves spatial information. Note that this computation is needed because the parametric HRTF model does not incorporate distance cues. A different HRTF set might incorporate such cues in which case the interpolation described by Equations 25a and 25b would not be necessary.

For each object, the panning coefficients for each of the three crosstalk cancellers are computed from the object position $\{x_i\ y_i\ z_i\}$ relative to the orientation of each canceller. The upward firing speaker pair 510 is meant to convey sounds from above by reflecting sound off of the ceiling or other upper surface of the listening environment. As such, its associated panning coefficient is proportional to the elevation coordinate $z_i$. The panning coefficients of the front and side firing pairs are governed by the object angle $\theta_i$, derived from the $\{x_i\ y_i\}$ coordinates. When the absolute value of $\theta_i$ is less than 30 degrees, object is panned entirely to the front pair 506. When the absolute value of $\theta_i$ is between 30 and 90 degrees, the object is panned between the front and side pairs 506 and 508; and when the absolute value of $\theta_i$ is greater than 90 degrees, the object is panned entirely to the side pair 508. With this panning algorithm, a listener in the sweet spot 502 receives the benefits of all three cross-talk cancellers. In addition, the perception of elevation is added with the upward-firing pair, and the side-firing pair adds an element of diffuseness for objects mixed to the side and back, which can enhance perceived envelopment. For listeners outside of the sweet-spot, the cancellers lose much of their effectiveness, but these listeners still get the perception of elevation from the upward-firing pair and the variation between direct and diffuse sound from the front to side panning.

As shown in diagram 400, an embodiment of the method involves computing panning coefficients based on object position using a panning function, step 404. Letting $\alpha_{iF}$, $\alpha_{iS}$, and $\alpha_{iH}$ represent the panning coefficients of the ith object into the Front, Side, and Height crosstalk cancellers, an algorithm for the computation of these panning coefficients is given by:

$$\alpha_{iH} = \sqrt{z_i} \text{ if } \mathrm{abs}(\theta_i) < 30, \quad \text{Equation No. (26a)}$$

$$\alpha_{iF} = \sqrt{(1-\alpha_{iH}^2)} \quad \text{Equation No. (26b)}$$

$$\alpha_{iS} = 0 \text{ else if } \mathrm{abs}(\theta_i) < 90, \quad \text{Equation No. (26c)}$$

$$\alpha_{iF} = \sqrt{(1-\alpha_{iH}^2)\frac{\mathrm{abs}(\theta_i)-90}{30-90}} \quad \text{Equation No. (26d)}$$

$$\alpha_{iS} = \sqrt{(1-\alpha_{iH}^2)\frac{\mathrm{abs}(\theta_i)-30}{90-30}} \text{ else,} \quad \text{Equation No. (26e)}$$

$$\alpha_{iF} = 0 \quad \text{Equation No. (26f)}$$

$$\alpha_{iS} = \sqrt{(1-\alpha_{iH}^2)} \quad \text{Equation No. (26g)}$$

It should be noted that the above algorithm maintains the power of every object signal as it is panned. This maintenance of power can be expressed as:

$$\alpha_{iF}^2+\alpha_{iS}^2+\alpha_{iH}^2=1 \quad \text{Equation No. (26h)}$$

In an embodiment, the virtualizer method and system using panning and cross correlation may be applied to a next generation spatial audio format as which contains a mixture of dynamic object signals along with fixed channel signals. Such a system may correspond to a spatial audio system as described in pending U.S. Provisional Patent Application 61/636,429, filed on Apr. 20, 2012 and entitled "System and Method for Adaptive Audio Signal Generation, Coding and Rendering," which is hereby incorporated by reference, and attached hereto as Appendix 2. In an implementation using surround-sound arrays, the fixed channels signals may be processed with the above algorithm by assigning a fixed spatial position to each channel. In the case of a seven channel signal consisting of Left, Right, Center, Left Surround, Right Surround, Left Height, and Right Height, the following {r θ z} coordinates may be assumed:

Left: {1, −30, 0}
Right: {1, 30, 0}
Center: {1, 0, 0}
Left Surround: {1, −90, 0}
Right Surround: {1, 90, 0}
Left Height {1, −30, 1}
Right Height {1, 30, 1}

As shown in FIG. 9, a preferred speaker layout may also contain a single discrete center speaker. In this case, the center channel may be routed directly to the center speaker rather than being processed by the circuit of FIG. 8. In the case that a purely channel-based legacy signal is rendered by the preferred embodiment, all of the elements in system 400 are constant across time since each object position is static. In this case, all of these elements may be pre-computed once at the startup of the system. In addition, the binaural filters, panning coefficients, and crosstalk cancellers may be pre-combined into M pairs of fixed filters for each fixed object.

Although embodiments have been described with respect to a collocated driver array with Front/Side/Upward firing drivers, any practical number of other embodiments is also possible. For example, the side pair of speakers may be excluded, leaving only the front facing and upward facing speakers. Also, the upward-firing pair may be replaced with a pair of speakers placed near the ceiling above the front facing pair and pointed directly at the listener. This configuration may also be extended to a multitude of speaker pairs spaced from bottom to top, for example, along the sides of a screen.

Equalization for Virtual Rendering

Embodiments are also directed to an improved equalization for a crosstalk canceller that is computed from both the crosstalk canceller filters and the binaural filters applied to a monophonic audio signal being virtualized. The result is improved timbre for listeners outside of the sweet-spot as well as a smaller timbre shift when switching from standard rendering to virtual rendering.

As stated above, in certain implementations, the virtual rendering effect is often highly dependent on the listener sitting in the position with respect to the speakers that is assumed in the design of the crosstalk canceller. For example, if the listener is not sitting in the right sweet spot, the crosstalk cancellation effect may be compromised, either partially or totally. In this case, the spatial impression intended by the binaural signal is not fully perceived by the listener. In addition, listeners outside of the sweet spot may often complain that the timbre of the resulting audio is unnatural.

To address this issue with timbre, various equalizations of the crosstalk canceller in Equation 15 have been proposed with the goal of making the perceived timbre of the binaural signal b more natural for all listeners, regardless of their position. Such an equalization may be added to the computation of the speaker signals according to:

$$s=ECb \quad \text{Equation No. (27)}$$

In the above Equation 27, E is a single equalization filter applied to both the left and right speakers' signals. To examine such equalization, Equation 15 can be rearranged into the following form:

$$C = \begin{bmatrix} EQF_L & 0 \\ 0 & EQF_R \end{bmatrix} \begin{bmatrix} 1 & -ITF_R \\ -ITF_L & 1 \end{bmatrix}, \quad \text{Equation No. (28)}$$

where $$ITF_L = \frac{H_{LR}}{H_{LL}},\ ITF_R = \frac{H_{RL}}{H_{RR}},$$

$$EQF_L = \frac{\frac{1}{H_{LL}}}{1-ITF_L ITF_R}, \text{ and}$$

$$EQF_R = \frac{\frac{1}{H_{RR}}}{1-ITF_L ITF_R}$$

If the listener is assumed to be placed symmetrically between the two speakers, then $ITF_L=ITF_R$ and $EQF_L=EQF_R$, and Equation 19 reduces to:

$$C = EQF\begin{bmatrix} 1 & -ITF \\ -ITF & 1 \end{bmatrix} \quad \text{Equation No. (29)}$$

Based on this formulation of the cross-talk canceller, several equalization filters E may be used. For example, in the case that the binaural signal is mono (left and right signals are equal), the following filter may be used:

$$E = \frac{1}{EQF(1-ITF)} \quad \text{Equation No. (30)}$$

An alternative filter for the case that the two channels of the binaural signal are statistically independent may be expressed as:

$$E = \sqrt{\frac{1}{|EQF|^2(1+|ITF|^2)}} \quad \text{Equation No. (31)}$$

Such equalization may provide benefits with respect to the perceived timbre of the binaural signal b. However, the binaural signal b is oftentimes synthesized from a monaural audio object signal o through the application of binaural rendering filters $B_L$ and $B_R$:

$$\begin{bmatrix} b_L \\ b_R \end{bmatrix} = \begin{bmatrix} B_L \\ B_R \end{bmatrix} o \text{ or } b = Bo \quad \text{Equation No. (32)}$$

The rendering filter pair B is most often given by a pair of HRTFs chosen to impart the impression of the object signal o emanating from an associated position in space relative to the listener. In equation form, this relationship may be represented as:

$$B = \text{HRTF}\{\text{pos}(o)\} \quad \text{Equation No. (33)}$$

In Equation 33, pos(o) represents the desired position of object signal o in 3D space relative to the listener. This position may be represented in Cartesian (x,y,z) coordinates or any other equivalent coordinate system such a polar. This position might also be varying in time in order to simulate movement of the object through space. The function HRTF{ } is meant to represent a set of HRTFs addressable by position. Many such sets measured from human subjects in a laboratory exist, such as the CIPIC database. Alternatively, the set might be comprised of a parametric model such as the spherical head model mentioned previously. In a practical implementation, the HRTFs used for constructing the crosstalk canceller are often chosen from the same set used to generate the binaural signal, though this is not a requirement.

Substituting Equation 32 into Equation 27 gives the equalized speaker signals computed from the object signal according to:

$$s = \text{ECB}o \quad \text{Equation No. (34)}$$

In many virtual spatial rendering systems, the user is able to switch from a standard rendering of the audio signal o to a binauralized, cross-talk cancelled rendering employing Equation 34. In such a case, a timbre shift may result from both the application of the crosstalk canceller C and the binauralization filters B, and such a shift may be perceived by a listener as unnatural. An equalization filter E computed solely from the crosstalk canceller, as exemplified by Equations 30 and 31, is not capable of eliminating this timbre shift since it does not take into account the binauralization filters. Embodiments are directed to an equalization filter that eliminates or reduces this timbre shift.

It should be noted that application of the equalization filter and crosstalk canceller to the binaural signal described by Equation 27 and of the binaural filters to the object signal described by Equation 32 may be implemented directly as matrix multiplication in the frequency domain. However, equivalent application may be achieved in the time domain through convolution with appropriate FIR (finite impulse response) or IIR (infinite impulse response) filters arranged in a variety of topologies. Embodiments apply generally to all such variations.

In order to design an improved equalization filter, it is useful to expand Equation 21 into its component left and right speaker signals:

$$\begin{bmatrix} s_L \\ s_R \end{bmatrix} = E\begin{bmatrix} EQF_L & 0 \\ 0 & EQF_R \end{bmatrix}\begin{bmatrix} 1 & -ITF_R \\ -ITF_L & 1 \end{bmatrix}\begin{bmatrix} B_L \\ B_R \end{bmatrix} o = E\begin{bmatrix} R_L \\ R_R \end{bmatrix} o \quad \text{Equation No. (35a)}$$

where $$R_L = (EQF_L)(B_L - B_R ITF_R) \quad \text{Equation No. (35b)}$$

$$R_R = (EQF_R)(B_R - B_L ITF_L) \quad \text{Equation No. (35c)}$$

In the above equations, the speaker signals can be expressed as left and right rendering filters $R_L$ and $R_R$ followed by equalization E applied to the object signal o. Each of these rendering filters is a function of both the crosstalk canceller C and binaural filters B as seen in Equations 35b and 35c. A process computes an equalization filter E as a function of these two rendering filters $R_L$ and $R_R$ with the goal achieving natural timbre, regardless of a listener's position relative to the speakers, along with timbre that is substantially the same when the audio signal is rendered without virtualization.

At any particular frequency, the mixing of the object signal into the left and right speaker signals may be expressed generally as $$\begin{bmatrix} s_L \\ s_R \end{bmatrix} = \begin{bmatrix} \alpha_L \\ \alpha_R \end{bmatrix} o \quad \text{Equation No. (36)}$$

In the above Equation 36, $\alpha_L$ and $\alpha_R$ are mixing coefficients, which may vary over frequency. The manner in which the object signal is mixed into the left and right speakers signals for non-virtual rendering may therefore be described by Equation 36. Experimentally it has been found that the perceived timbre, or spectral balance, of the object signal o is well modelled by the combined power of the left and right speaker signals. This holds over a wide listening area around the two loudspeakers. From Equation 36, the combined power of the non-virtualized speaker signals is given by:

$$P_{NV} = (|\alpha_L|^2 + |\alpha_R|^2)|o|^2 \quad \text{Equation No. (37)}$$

From Equations 26, the combined power of the virtualized speaker signals is given by $$P_V = |E|^2(|R_L|^2 + |R_R|^2)|o|^2 \quad \text{Equation No. (38)}$$

The optimum equalization filter $E_{opt}$ may be found by setting $P_V = P_{NV}$ and solving for E:

$$E_{opt} = \frac{|\alpha_L|^2 + |\alpha_R|^2}{|R_L|^2 + |R_R|^2} \quad \text{Equation No. (39)}$$

The equalization filter $E_{opt}$ in Equation 39 provides timbre for the virtualized rendering that is consistent across a wide listening area and substantially the same as that for non-virtualized rendering. It can be seen that in this example $E_{opt}$ is computed as a function of the rendering filters $R_L$ and $R_R$ which are in turn functions of both the crosstalk canceller C and the binauralization filters B.

In many cases, mixing of the object signal into the left and right speakers for non-virtual rendering will adhere to a power preserving panning law, meaning that the equivalence of Equation 40 below holds for all frequencies.

$$|\alpha_L|^2+|\alpha_R|^2=1 \quad \text{Equation No. (40)}$$

In this case the equalization filter simplifies to:

$$E_{opt} = \frac{1}{|R_L|^2 + |R_R|^2} \quad \text{Equation No. (41)}$$

With the utilization of this filter, the sum of the power spectra of the left and right speaker signals is equal to the power spectrum of the object signal.

Figure 10:
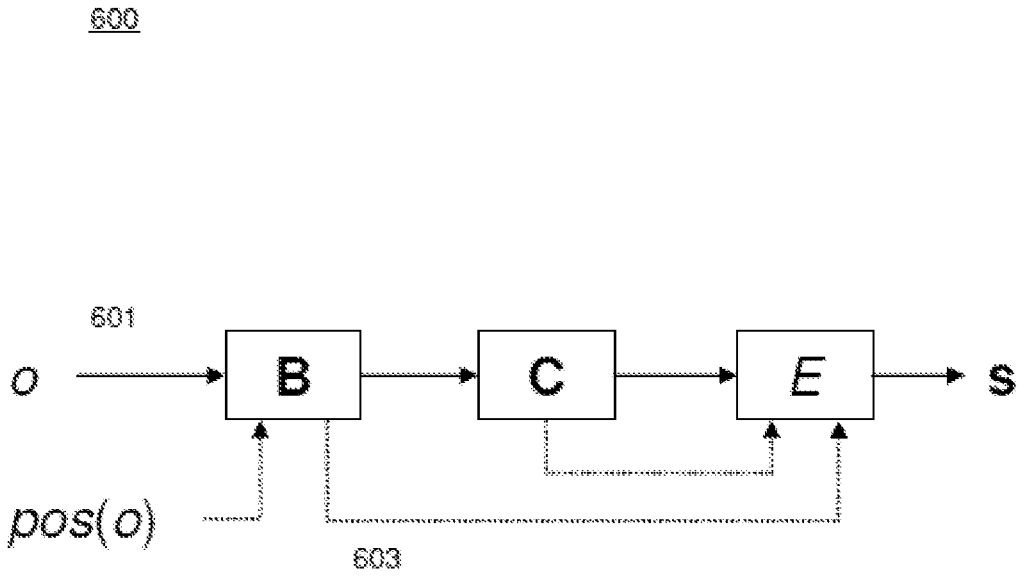
FIG. 10 is a diagram that depicts an equalization process applied for a single object o, according to one embodiment.
Figure 11:
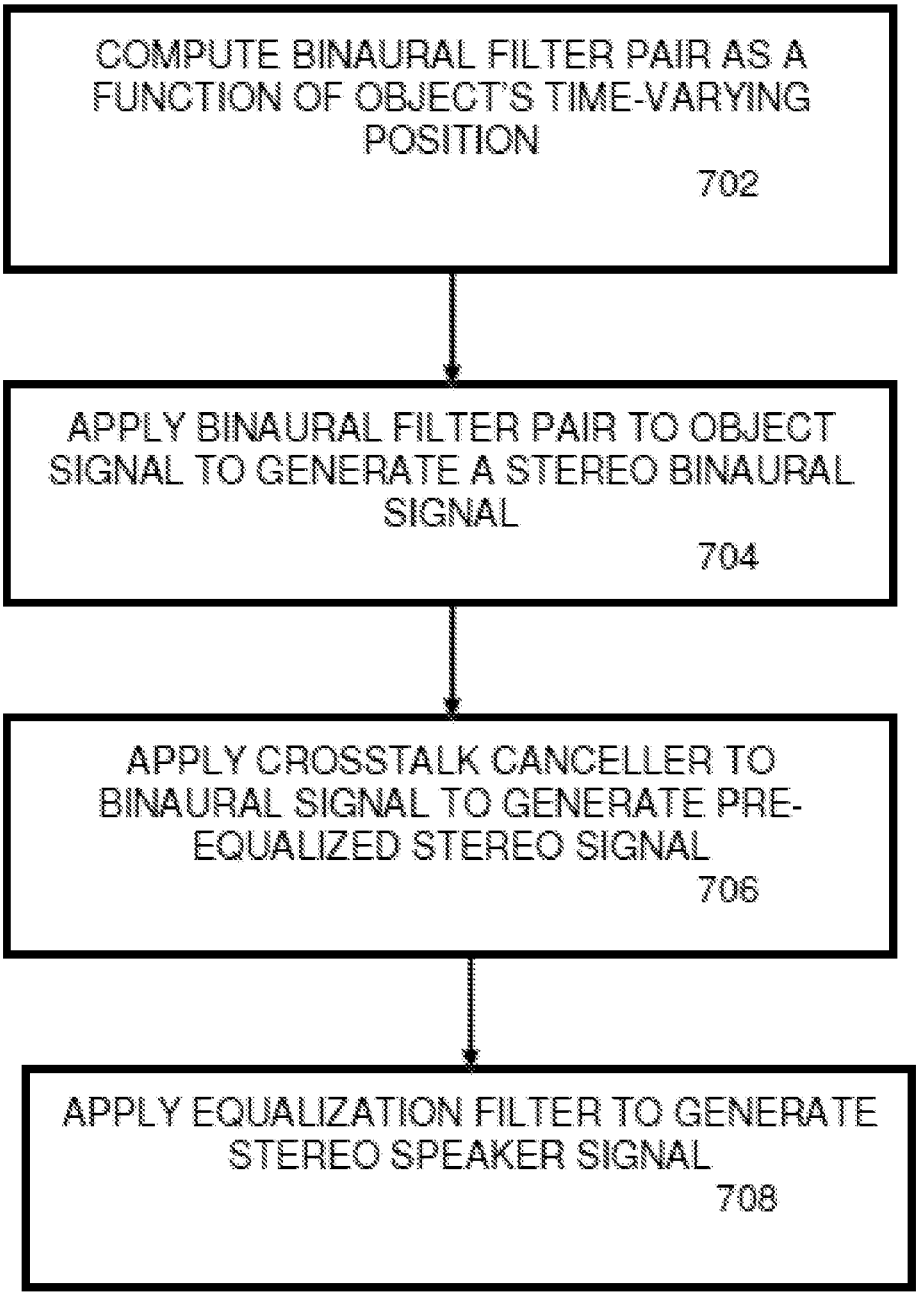
FIG. 11 is a flowchart that illustrates a method of performing the equalization process for a single object, according to one example.

FIG. 10 is a diagram that depicts an equalization process applied for a single object o, according to one embodiment. FIG. 11 is a flowchart that illustrates a method of performing the equalization process for a single object, according to one example. As shown in diagram 700, the binaural filter pair B is first computed as a function of the object's possibly time varying position, step 702, and then applied to the object signal to generate a stereo binaural signal, step 704. Next, as shown in step 706, the crosstalk canceller C is applied to the binaural signal to generate a pre-equalized stereo signal. Finally, the equalization filter E is applied to generate the stereo loudspeaker signal s, step 708. The equalization filter may be computed as a function of both the crosstalk canceller C and binaural filter pair B. If the object position is time varying, then the binaural filters will vary over time, meaning that the equalization E filter will also vary over time. It should be noted that the order of steps illustrated in FIG. 11 is not strictly fixed to the sequence shown. For example, the equalizer filter process 708 may applied before or after the crosstalk canceller process 706. It should also be noted that, as shown in FIG. 10, the solid lines 601 are meant to depict audio signal flow, while the dashed lines 603 are meant to represent parameter flow, where the parameters are those associated with the HRTF function.

In many applications, a multitude of audio object signals placed at various, possibly time-varying positions in space are simultaneously rendered. In such a case, the binaural signal is given by a sum of object signals with their associated HRTFs applied:

$$b = \sum_{i=1}^{N} B_i o_i \text{ where } B_i = HRTF\{pos(o_i)\} \quad \text{Equation No. (42)}$$

With this multi-object binaural signal, the entire rendering chain to generate the speaker signals, including the inventive equalization, is given by:

$$s = C\sum_{i=1}^{N} E_i B_i o_i \quad \text{Equation No. (43)}$$

In comparison to the single-object Equation 34, the equalization filter has been moved ahead of the crosstalk canceller. By doing this, the cross-talk, which is common to all component object signals, may be pulled out of the sum. Each equalization filter $E_i$, on the other hand, is unique to each object since it is dependent on each object's binaural filter $B_i$.

Figure 12:
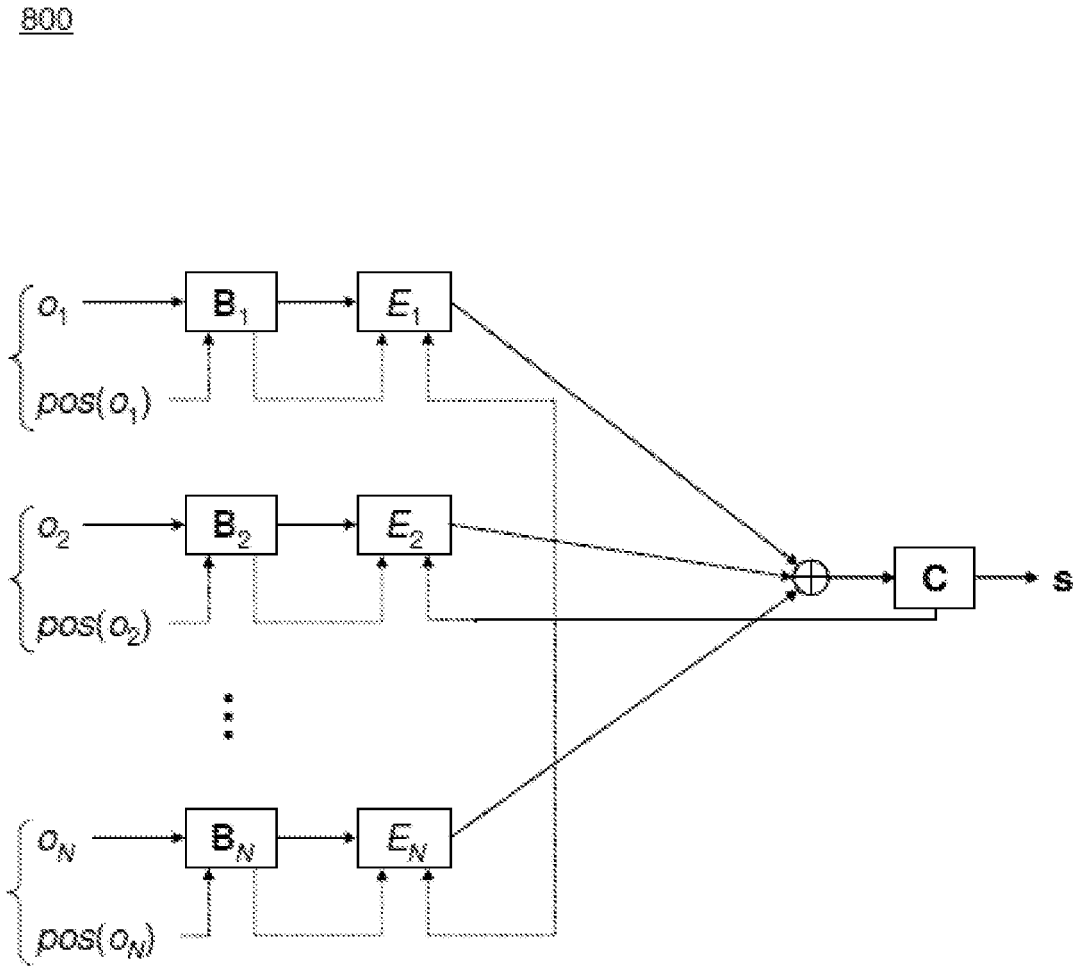
FIG. 12 is a block diagram of a system applying an equalization process simultaneously to multiple objects input through the same cross-talk canceller, according to one example.

FIG. 12 is a block diagram 800 of a system applying an equalization process simultaneously to multiple objects input through the same cross-talk canceller, according to one example. In many applications, the object signals $o_i$ are given by the individual channels of a multichannel signal, such as a 5.1 signal comprised of left, center, right, left surround, and right surround. In this case, the HRTFs associated with each object may be chosen to correspond to the fixed speaker positions associated with each channel. In this way, a 5.1 surround system may be virtualized over a set of stereo loudspeakers. In other applications the objects may be sources allowed to move freely anywhere in 3D space. In the case of a next generation spatial audio format, the set of objects in Equation 43 may consist of both freely moving objects and fixed channels.

When AC-4 Immersive Stereo is reproduced on a mobile device, cross-talk cancellation can be employed in various ways. However, without certain precautions and overcoming limitations of a simple cascade of an AC-4 decoder and a cross-talk canceller, the end-user listener experience may be sub-optimal.

Current cross-talk cancellers come with a number of potential limitations relevant to application within an AC-4 Immersive Stereo context:

1) Without application of an equalization process, the perceived timbre of a cross-talk canceller may be altered, resulting in a colored sound or timbre shift that is different from the original artistic intent.
2) The exact details or frequency response of the equalization filter may depend on the object position. For example, some implementations described above disclose an improved equalization process that is employed for each input (object or bed) and which depends on object metadata. However, those implementations do not indicate with specificity how such processes could be employed for presentations (e.g. mixtures of objects).
3) Even if the improved equalization methods outlined above are employed on a per-object basis, certain objects present in the content may suffer from severe timbre shifts. In particular, objects or beds that are mutually correlated (for example to create a phantom image) may suffer from comb-filter like cancellation and resonances, even if every object or input is equalized independently. These effects may occur because the equalization filter may not take inter-object relationships (correlations) into account into its optimization process.
4) In the context of AC-4 Immersive Stereo, a per-object cross-talk cancellation equalization filter cannot be employed if the cross-talk canceller is operating in the decoder. During the dual-ended approach, only presentations (binaural or stereo) are accessible.
5) Cross-talk cancellation algorithms typically ignore the effect of the reproduction environment (e.g. the presence of reflections and late reverberation). The presence of reflections can change the perceived timbre significantly, in particular because cross-talk cancellation algorithms tend to increase the acoustic power in certain frequency ranges as reproduced by the loudspeakers.

Some disclosed implementations can overcome one or more of the above listed limitations. Some such implementations extend a previously-disclosed audio decoder, e.g., the AC-4 Immersive Stereo decoder. Some implementations may include one or more of the following features:

1) In some examples, the decoder may include a static cross-talk cancellation filter (matrix) operating on one of the presentations available to an Immersive Stereo decoder (stereo or binaural);
2) In case the binaural presentation is employed as input for cross-talk cancellation, the acoustic room simulation algorithm in the AC-4 Immersive Stereo decoder may be disabled;
3) Some implementations may include a dynamic equalization process to improve the timbre that uses one of the two presentations (binaural or stereo) as a target curve.

Figure 13:
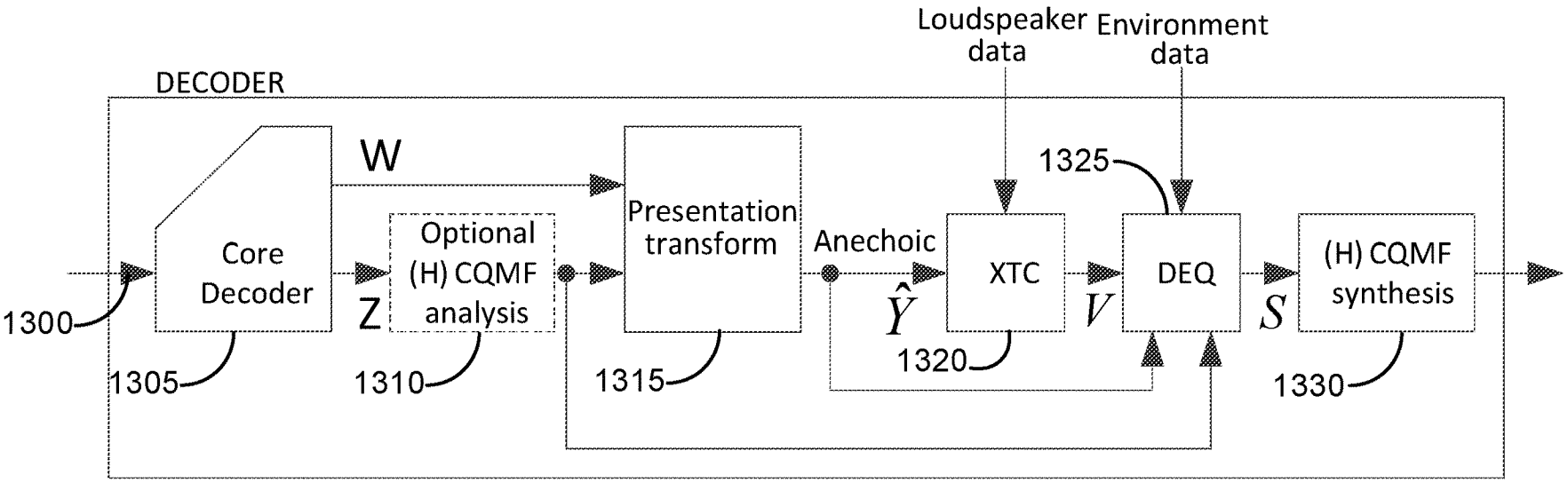
FIG. 13 illustrates a schematic diagram of an Immersive Stereo decoder in accordance with one example.

FIG. 13 illustrates a schematic diagram of an Immersive Stereo decoder in accordance with one example. FIG. 13 illustrates a core decoder 1305 that decodes the input bitstream 1300 into a stereo loudspeaker presentation Z. This presentation is optionally (and preferably) transformed, via the presentation transform block 1315, into an anechoic binaural presentation Y using transformation data W. The signal Y is subsequently processed by a cross-talk cancellation process 1320 (labeled XTC in FIG. 13), which may be dependent on loudspeaker data. The cross-talk cancellation process 1320 outputs a cross-talk cancelled stereo signal V. A dynamic equalization process 1325 (labeled DEQ in FIG. 13), which may optionally be dependent on environment data, may subsequently process the signals V to determine a stereo output loudspeaker signal S. If the processes for cross-talk cancellation and/or dynamic equalization are applied in a transform or filter-bank domain (e.g., via the optional halfband quadrature mirror filter or (H)CQMF process 1310 shown in FIG. 13), the last step may be an inverse transform or synthesis filter bank (H)CQMF 1330 to convert the signals to time-domain representations. In some implementations, examples of which are described below, the DEQ process may receive signals Z or Y to compute a target curve.

In some embodiments, cross-talk cancellation method may involve processing signals in a transform or filter bank domain. The processes described may be applied to one or more sub bands of these signals. For simplicity of notation, and without loss of generality, sub-band indices will be omitted.

A stereo or binaural signal $y_l$, $y_r$ enters the cascade of cross-talk cancellation and dynamic equalization processing stages, resulting in stereo output loudspeaker signal pair $s_l$, $s_r$. The process is assumed to be realizable in matrix notation based on the following:

$$\begin{bmatrix} s_l \\ s_r \end{bmatrix} = G\begin{bmatrix} c_{11} & c_{12} \\ c_{21} & c_{22} \end{bmatrix}\begin{bmatrix} y_l \\ y_r \end{bmatrix} = GC\begin{bmatrix} y_l \\ y_r \end{bmatrix} \quad \text{Equation No. 44}$$

In Equation 44, $c_{11}$-$c_{22}$ represent the coefficients of the cross-talk matrix. The matrices G and C represent the dynamic equalization (DEQ) and cross-talk cancellation (XTC) processes, respectively. In time-domain implementations, or in filter-bank implementations with a limited number of sub-bands, these matrices may be convolution matrices to realize frequency-dependent processing.

Cross-talk cancelled signals at the output of the cross-talk canceller and input to the dynamic equalization algorithm are denoted by $v_l$, $v_r$ and may, in some examples, be determined based on the following:

$$\begin{bmatrix} v_l \\ v_r \end{bmatrix} = \begin{bmatrix} c_{11} & c_{12} \\ c_{21} & c_{22} \end{bmatrix}\begin{bmatrix} y_l \\ y_r \end{bmatrix} = C\begin{bmatrix} y_l \\ y_r \end{bmatrix} \quad \text{Equation No. 45}$$

In some examples, one or more target signals $x_l$, $x_r$ may be available to the dynamic equalization algorithm to compute G. The dynamic equalization matrix may be a scalar g in each sub-band.

According to some implementations, the cross-talk cancellation matrix may be obtained by inverting the acoustic path from loudspeakers to eardrums (e.g., by the path illustrated in FIG. 5):

$$\begin{bmatrix} e_l \\ e_r \end{bmatrix} = \begin{bmatrix} h_{ll} & h_{rl} \\ h_{lr} & h_{rr} \end{bmatrix}\begin{bmatrix} s_l \\ s_r \end{bmatrix} = H\begin{bmatrix} s_l \\ s_r \end{bmatrix} \quad \text{Equation No. 46}$$

In Equation 46, $h_{ll}$, $h_{lr}$, $h_{lr}$ and $h_{rr}$ correspond with $H_{LL}$, $H_{LR}$, $H_{RL}$ and $H_{RR}$ shown in FIG. 5 and described above. Accordingly, C may be expressed as follows:

$$C=(H^T H+\epsilon I)^{-1} H^T \quad \text{Equation No. 47}$$

In Equation 47, $H^T$ represents a Hermitian matrix transposed operation on the matrix H, I represents the identity matrix and $\epsilon$ represents a regularization term, which can be useful when the matrix H is of low rank. The regularization term $\epsilon$ may be a small fraction of the matrix norm; in other words $\epsilon$ may be small compared to the elements in the matrix H. The matrix H, and therefore the matrix C will depend on the position (azimuth angle) of the loudspeakers. Furthermore, as long as the loudspeaker positions are static, the matrix C will generally be constant across time while its effect will generally be varying over frequency due to the frequency dependencies in HRTFs $h_{ij}$.

Dynamic Equalization

Some examples of the dynamic equalization (DEQ) algorithm are based on (running) energy estimates of the target signals ($x_l$, $x_r$) and the output of the cross-talk cancellation (XTC) stage ($v_l$, $v_r$), e.g., as follows:

$$\begin{bmatrix} s_l \\ s_r \end{bmatrix} = G\begin{bmatrix} v_l \\ v_r \end{bmatrix} = g\begin{bmatrix} v_l \\ v_r \end{bmatrix} \quad \text{Equation No. 48}$$

In Equation 48, G is a matrix that represents DEQ. In this example, the scalar g may be based on level, power, loudness and/or energy estimator operators $\Sigma(.)$, e.g., as follows:

$$\Sigma_v^2=\langle v_l^2\rangle+\langle v_r^2\rangle \quad \text{Equation No. 49a}$$

$$\Sigma_x^2=\langle x_l^2\rangle+\langle x_r^2\rangle \quad \text{Equation No. 49b}$$

Estimates $\Sigma_{v,x}^2$ may be determined in various ways, including running average estimators with leaky integrators, windowing and integration, etc. The matrix G or scalar g may, in some examples, subsequently be computed from $\Sigma_v^2$ and $\Sigma_x^2$ as follows:

$$G=f(\Sigma_v^2,\Sigma_x^2) \quad \text{Equation No. 50}$$

The matrix G or scalar g may be designed to ensure that the stereo loudspeaker output signals $s_l$, $s_r$ (e.g. the output of the dynamic equalization stage) have an energy that is equal, or close(r) to the energy of the target signals ($x_l$, $x_r$), e.g., as follows:

$$\Sigma_v^2 \leq \Sigma_s^2 \leq \Sigma_x^2 \text{ if } \Sigma_v^2 \leq \Sigma_x^2 \quad \text{Equation No. 51a}$$

$$\Sigma_v^2 \geq \Sigma_s^2 \geq \Sigma_x^2 \text{ if } \Sigma_v^2 > \Sigma_x^2 \quad \text{Equation No. 51b}$$

Figure 14:
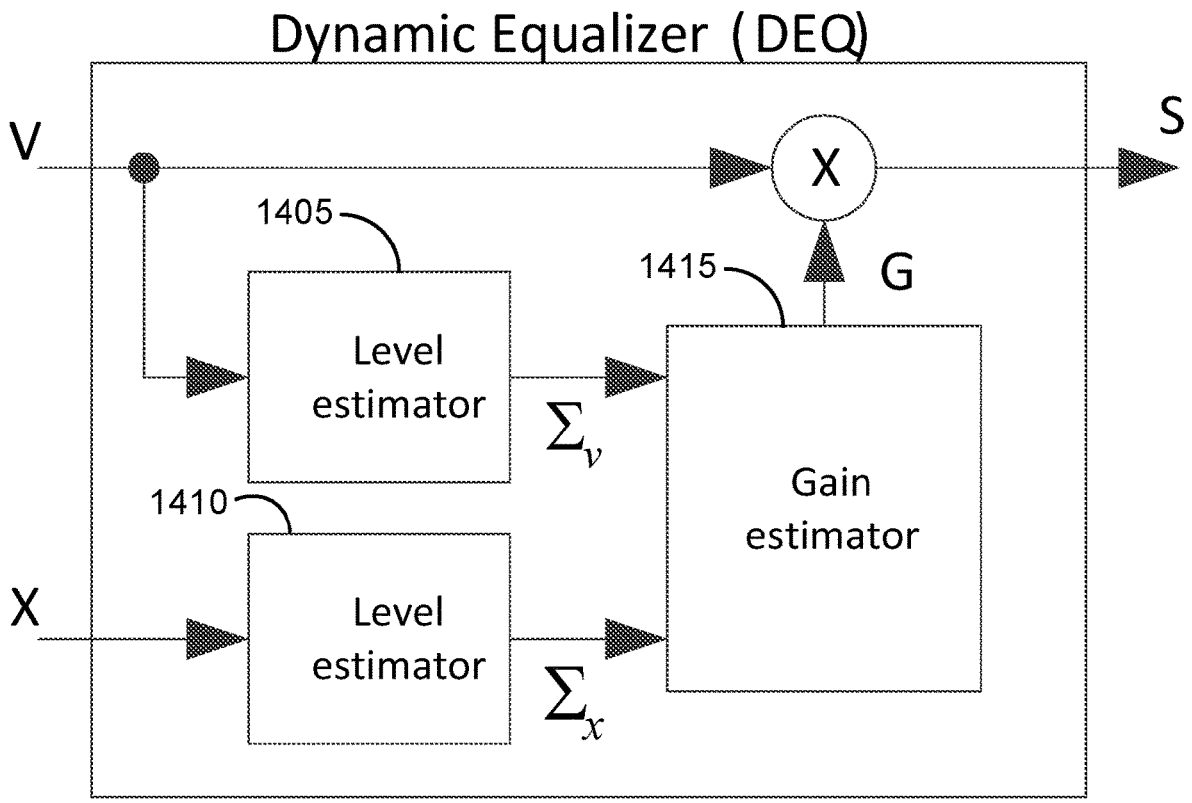
FIG. 14 illustrates a schematic overview of a dynamic equalization stage according to one example.

FIG. 14 illustrates a schematic overview of a dynamic equalization stage according to one example. According to this example, the stereo cross-talk cancelled signal V ($v_l$, $v_r$) and target signal X ($x_l$, $x_r$) are processed by level estimators 1405 and 1410, respectively, and subsequently a dynamic equalization gain G is calculated by the gain estimator 1415 and applied to signal V ($v_l$, $v_r$) to compute stereo output loudspeaker signal S ($s_l$, $s_r$).

In some embodiments, the level, power, loudness and/or energy estimator operations to obtain $\Sigma_v^2$ may be based on the corresponding level estimation $\Sigma_x^2$ of the signal pair $x_l$, $x_r$ or based on the level estimation $E_y^2$ of the signal pair $y_l$, $y_r$ instead of analysing the signal pair $v_l$, $y_r$ directly. One examples of a method to obtain $\Sigma_v^2$ from the signal pair $y_1$, $y_r$ would be to measure the covariance matrix of the signal pair $y_l$, $y_r$:

$$R_{yy} = YY^T = \begin{bmatrix} y_l \\ y_r \end{bmatrix} [\, y_l^* \quad y_r^* \,] \quad \text{Equation No. 52}$$

In the foregoing expression, (*) represents the complex conjugation operator. The covariance matrix of the signal pair $v_l$, $v_r$ may be estimated based on:

$$R_{vv} = VV^T = \begin{bmatrix} v_l \\ v_r \end{bmatrix} [\, v_l^* \quad v_r^* \,] = CYY^TC^T = CR_{yy}C^T \quad \text{Equation No. 53}$$

Then the energy $\Sigma_v^2$ is given by the trace of the matrix $R_{vv}$:

$$\Sigma_v^2 = \text{trace}(R_{vv}) \quad \text{Equation No. 54}$$

Thus for a known cross-talk cancellation matrix C, the level estimate $E_v^2$ can be derived from the signals $y_l$, $y_r$. Moreover, by simple substitution, it follows that the same technique can be used to estimate or compute $\Sigma_v^2$ from the signal pair $x_l$, $x_r$.

In one embodiment the dynamic equalization gain G is determined based on:

$$g^2 = \frac{\sum_x^2 + \alpha^2 \sum_v^2}{\sum_v^2 + \alpha^2 \sum_v^2} \quad \text{Equation No. 55}$$

In this example, the strength or value of equalization may be based on the parameter α. For example, a full equalization may be achieved when α=0, whereas no equalization may be achieved when α=∞(e.g., when g=1). When no equalization is achieved, the parameter α can be interpreted as the ratio of direct and reverberant energy received by a listener in a reproduction environment. In other words, an anechoic environment would correspond to α=∞, and no equalization will be employed (g=1) because the cross-talk cancellation model inherently assumes an anechoic environment. In echoic environments, on the other hand, the listener will perceive an increased amount of timbre shift due to the addition of reflections and late reverberation, and therefore a stronger equalization should be employed (e.g. a finite value of α). The parameter a is thus environment dependent, and may be frequency dependent as well. Some examples of values of a that work well are found to be in the range within, but not limited to 0.5 to 5.0.

In another embodiment, g may be based on:

$$g^2 = \left( \frac{\sum_x^2}{\sum_v^2} \right)^\beta \quad \text{Equation No. 56}$$

The parameter β may allow the application of values ranging from no equalization (β=0) and full equalization (β=1). The value of β can be frequency dependent (e.g., different amounts of equalization are performed as a function of frequency). The value of β can, for example, be 0.1, 0.5, or 0.9.

In another embodiment, partial equalization based on acoustic phenomena may be determined based on the following. For this technique, for an anechoic signal path:

$$\begin{bmatrix} e_l \\ e_r \end{bmatrix} = H \begin{bmatrix} s_l \\ s_r \end{bmatrix} = HGC \begin{bmatrix} y_l \\ y_r \end{bmatrix} = HG \begin{bmatrix} v_l \\ v_r \end{bmatrix} \quad \text{Equation No. 57}$$

Here, C represents the cross-talk cancellation matrix, H represents the acoustic pathway between speakers and eardrums, and G represents the dynamic equalization (DEQ) gain. The acoustic environment in which the reproduction system is present may, in some examples, be excited by two speaker signals. The acoustic energy may be estimated to be equal to $g^2\Sigma_v^2$. Assuming that HGC=GHC=G, the energy at the level of the eardrums, $\Sigma_e^2$, is then equal to:

$$\Sigma_e^2 = g^2\Sigma_y^2 + g^2\alpha^2\Sigma_v^2 \quad \text{Equation No. 58}$$

The parameter α in Equation Nos. 58-60 represents the amount of room reflections and late reverberation in relation to the direct sound. In other words, in Equation No. 58, α is the inverse of the direct-to-reverberant ratio. This ratio is typically dependent on listener distance, room size, room acoustic properties, and frequency. When there is a boundary condition of $\Sigma_e^2 = \Sigma_x^2$, the dynamic EQ gain may be determined based on:

$$g^2 = \frac{\sum_x^2}{\sum_y^2 + \alpha^2 \sum_v^2} \quad \text{Equation No. 59}$$

The value of parameter a of Equation Nos. 58-60 may, in some examples, be in the range of 0.1-0.3 for near-field listening and may be larger than +1 for far-field listening (e.g., listening at a distance beyond the critical distance).

Equation No. 59 may be simplified to assume that the desired energy at the level of the eardrums is equal to that of the binaural signal headphone signal, and thus:

$$g^2 = \frac{\sum_y^2}{\sum_y^2 + \alpha^2 \sum_v^2} \quad \text{Equation No. 60}$$

In another embodiment, the dynamic equalization gain is computed using $\alpha^2$ as a 'blending' parameter for the dominator to use $\Sigma_y^2$, $\Sigma_v^2$ $$g^2 = \frac{\sum_{y}^{2}}{(1-\alpha^2)\sum_{y}^{2} + \alpha^2 \sum_{v}^{2}} \quad \text{Equation No. 61}$$

The dynamic equalization gain (as a function of time and frequency) may be determined based on acoustic environment data, which could correspond to one or more of:

A distance between listener and loudspeaker(s);

An (estimate of the) direct-to-late reverberation ratio at the listener position;

Room acoustic properties of the playback environment;

The room size of the playback environment;

Acoustic absorption data of the acoustic environment.

In an echoic environment, such as a living room, an office space, etc., the direct sound eminated by a loudspeaker will typically decrease in level by about 6 dB per doubling of the propagated distance. Besides such direct sounds, the the sound pressure at the listner's position will also include early reflections and late reverberation due to the limited absorption of sound by walls, ceilings, floors and furniture. The energy of these early reflections and late reverberation is typically much more homogenously distributed in the environment. Moreover, as acoustical absorption is typically frequency-dependent, the spectral profile of the late reverberation is generally different from that emanated by the loudspeaker. Consequently, depending on frequency and distance between the loudspeaker and listener, the direct-to-late energy may vary greatly. The embodiments that involve computing the dynamic equalization gain according to the acoustic environment may be based, at least in part, the direct-to-late energy ratio. This ratio may be measured, estimated, or assumed to have a fixed value for a typical use case of the device at hand.

Within the context of AC-4 Immersive Stereo, either the stereo loudspeaker presentation (z) or the binaural headphone presentation (y) can be selected as target signal (x) for the dynamic equalization stage.

Binaural Headphone Presentation as Target

The binaural headphone presentation (y) may include inter-aural localization cues (such as inter-aural time and/or inter-aural level differences) to influence the perceived azimuth angle, as well as spectral cues (peaks and notches) that have an effect on the perceived elevation. If the dynamic equalization process is implemented as a scalar g common to both channels, inter-aural localization cues should be preserved. Furthermore, if the cross-talk cancelled signal v in each frequency band is equalized to have the same energy as binaural presentation signal y, the elevation cues present in y should be maintained in stereo output loudspeaker signal s. When the resulting signal s is reproduced on loudspeakers (e.g. on a mobile device), the signal will be modified by the acoustic pathway from speaker to eardrums.

Stereo Loudspeaker Presentation as Target

An alternative that may alleviate the need of an inverse HRTF filter T employs the loudspeaker presentation as a target signal. In that case, the equalized signals should be free of any peaks and notches and localization may rely on the spectral cues induced by the acoustic pathway from the loudspeakers to the eardrums. However any front/back or elevation cues may be lost in the perceived presentation. This might nevertheless be an acceptable trade-off because front/back and elevation cues do typically not work well with cross-talk cancellation algorithms Audio Renderer Besides using the dynamic equalization concept in the context of AC-4 Immersive Stereo, dynamic equalization may be employed in an audio renderer that employs cross-talk cancellation.

Figure 15:
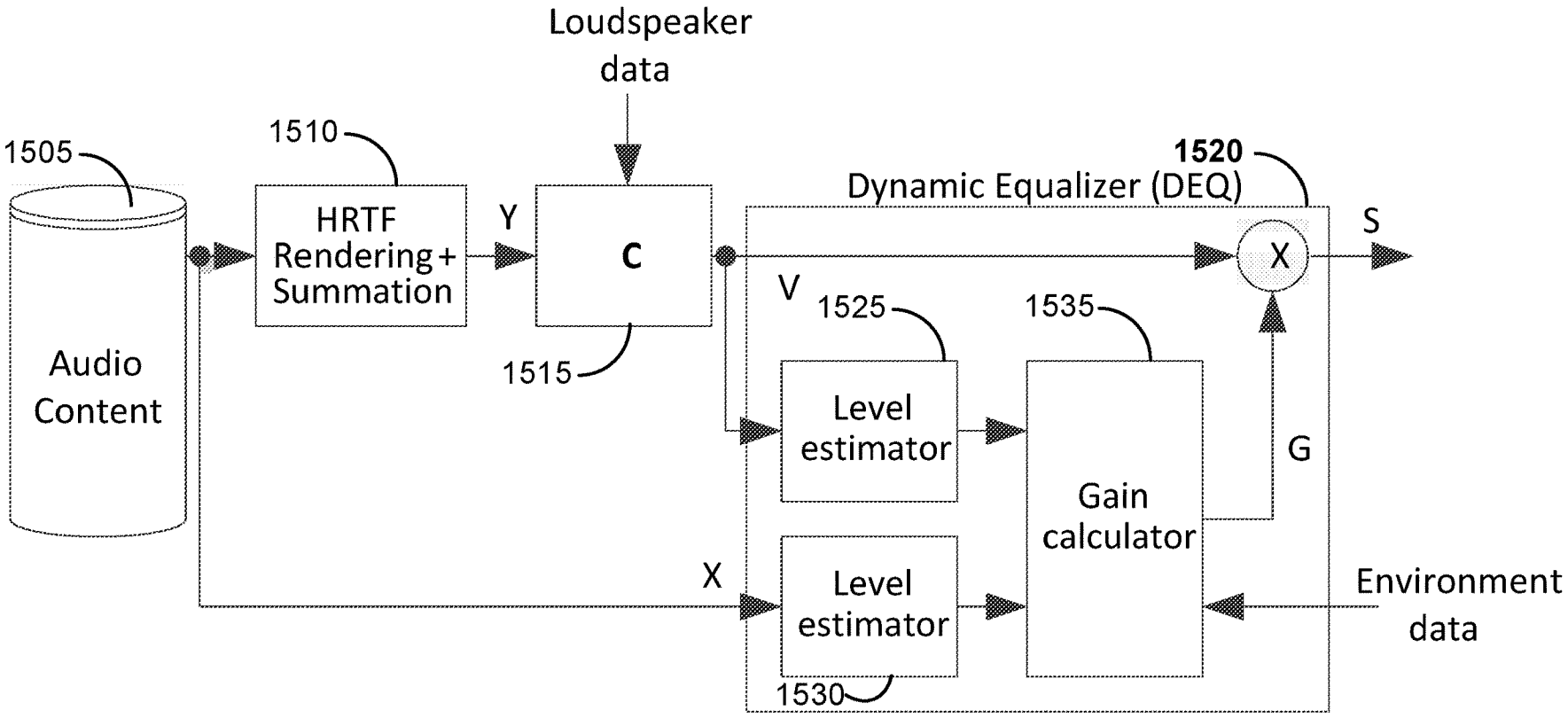
FIG. 15 illustrates a schematic overview of a renderer according to one example.

FIG. 15 illustrates a schematic overview of a renderer according to one example. In this implementation, audio content 1505 (which may be channel- or object-based) may be processed (rendered) by HRTFs and summed via the HRTF rendering and summation process 1510 to create a binaural stereo signal Y, e.g. as follows:

$$y_i = \Sigma_j x_j * h_{ij} \quad \text{Equation No. 62}$$

In Equation 62, $x_j$ represents an input signal (bed or object) with index j, $h_{ij}$ represents the HRTF for object j and output signal i, and * represents the convolution operator.

The binaural signal pair Y ($y_l$, $y_r$) may subsequently be processed by a cross-talk cancellation matrix C (block 1515) to compute a cross-talk cancelled signal pair V. As described previously, the cross-talk cancellation matrix C depends on the position (azimuth angle) of the loudspeakers. The stereo signal V may subsequently be processed by a dynamic equalization (DEQ) stage 1520 to produce stereo loudspeaker output signal pair S.

The gain G applied by the dynamic equalization stage 1520 may be derived from level estimates of V and X, which are calculated by level estimators 1525 and 1530, respectively, in this example. The level estimates may involve summing over channels where appropriate. According to one such example, the summing may be as follows:

$$\Sigma_v^2 = \langle v_l^2 \rangle + \langle v_r^2 \rangle \quad \text{Equation No. 49a}$$

$$\Sigma_x^2 = \Sigma_j \langle x_j^2 \rangle \quad \text{Equation No. 49b}$$

In other words, instead of using a presentation (rendering) as a target signal, the content itself (channels, objects, and/or beds) may be used to compute the target level. The resulting gain G is calculated by the gain calculator 1535 in this example. The gain may, for example, be computed using any of the methods described in connection with Equation Nos. 44-62, and may, depending on the employed method, be dependent on acoustic environment information.

Figure 16:
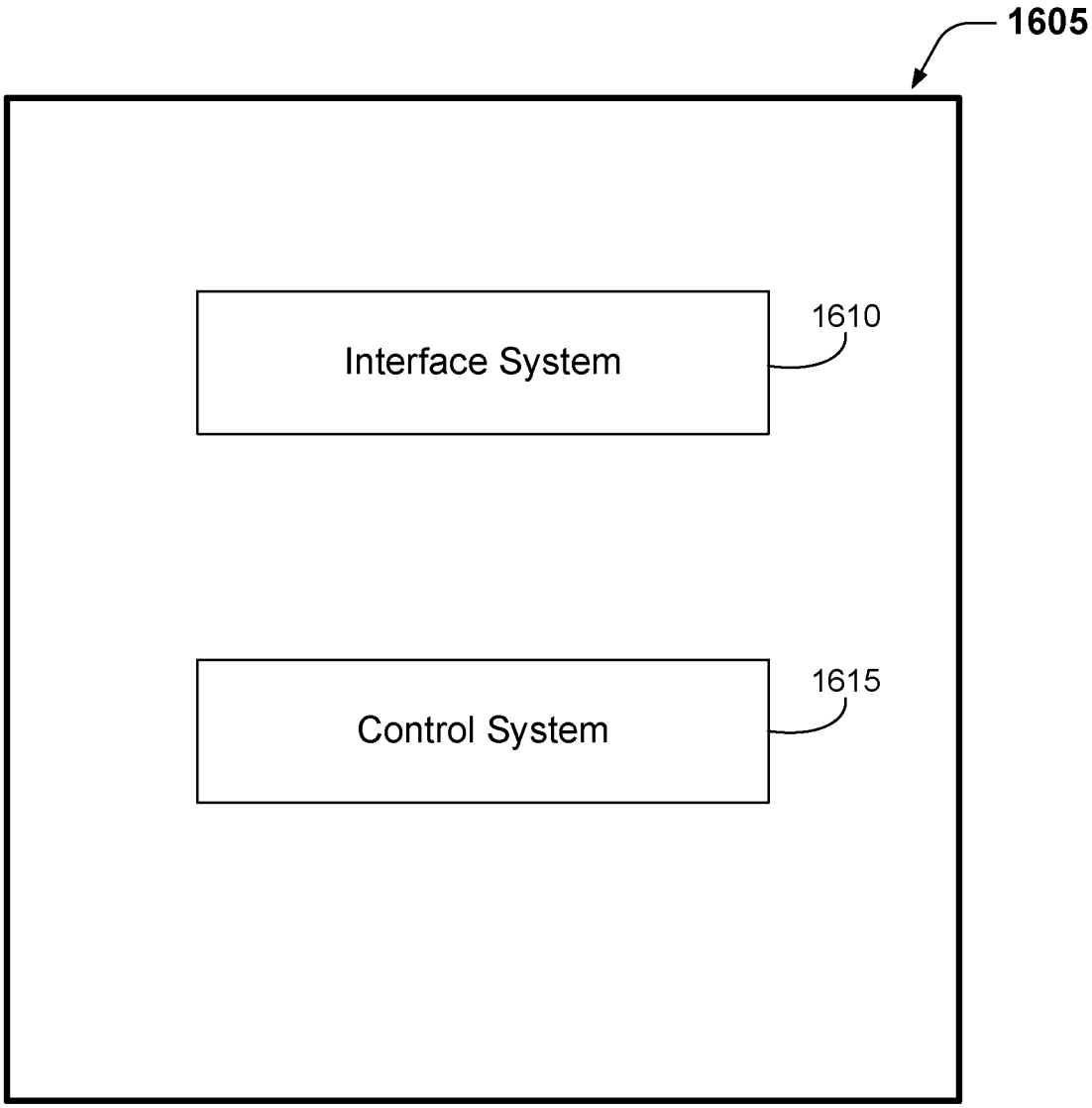
FIG. 16 is a block diagram that shows examples of components of an apparatus that may be configured to perform at least some of the methods disclosed herein.

FIG. 16 is a block diagram that shows examples of components of an apparatus that may be configured to perform at least some of the methods disclosed herein. In some examples, the apparatus 1605 may be a mobile device. According to some implementations, the apparatus 1605 may be a device that is configured to provide audio processing for a reproduction environment, which may in some examples be a home reproduction environment. According to some examples, the apparatus 1605 may be a client device that is configured for communication with a server, via a network interface. The components of the apparatus 1605 may be implemented via hardware, via software stored on non-transitory media, via firmware and/or by combinations thereof. The types and numbers of components shown in FIG. 16, as well as other figures disclosed herein, are merely shown by way of example. Alternative implementations may include more, fewer and/or different components.

In this example, the apparatus 1605 includes an interface system 1610 and a control system 1615. The interface system 1610 may include one or more network interfaces, one or more interfaces between the control system 1615 and a memory system and/or one or more external device interfaces (such as one or more universal serial bus (USB) interfaces). In some implementations, the interface system 1610 may include a user interface system. The user interface system may be configured for receiving input from a user. In some implementations, the user interface system may be configured for providing feedback to a user. For example, the user interface system may include one or more displays with corresponding touch and/or gesture detection systems. In some examples, the user interface system may include one or more speakers. According to some examples, the user interface system may include apparatus for providing haptic feedback, such as a motor, a vibrator, etc. The control system 1615 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components.

In some examples, the apparatus 1605 may be implemented in a single device. However, in some implementations, the apparatus 1605 may be implemented in more than one device. In some such implementations, functionality of the control system 1615 may be included in more than one device. In some examples, the apparatus 1605 may be a component of another device.

Figure 17:
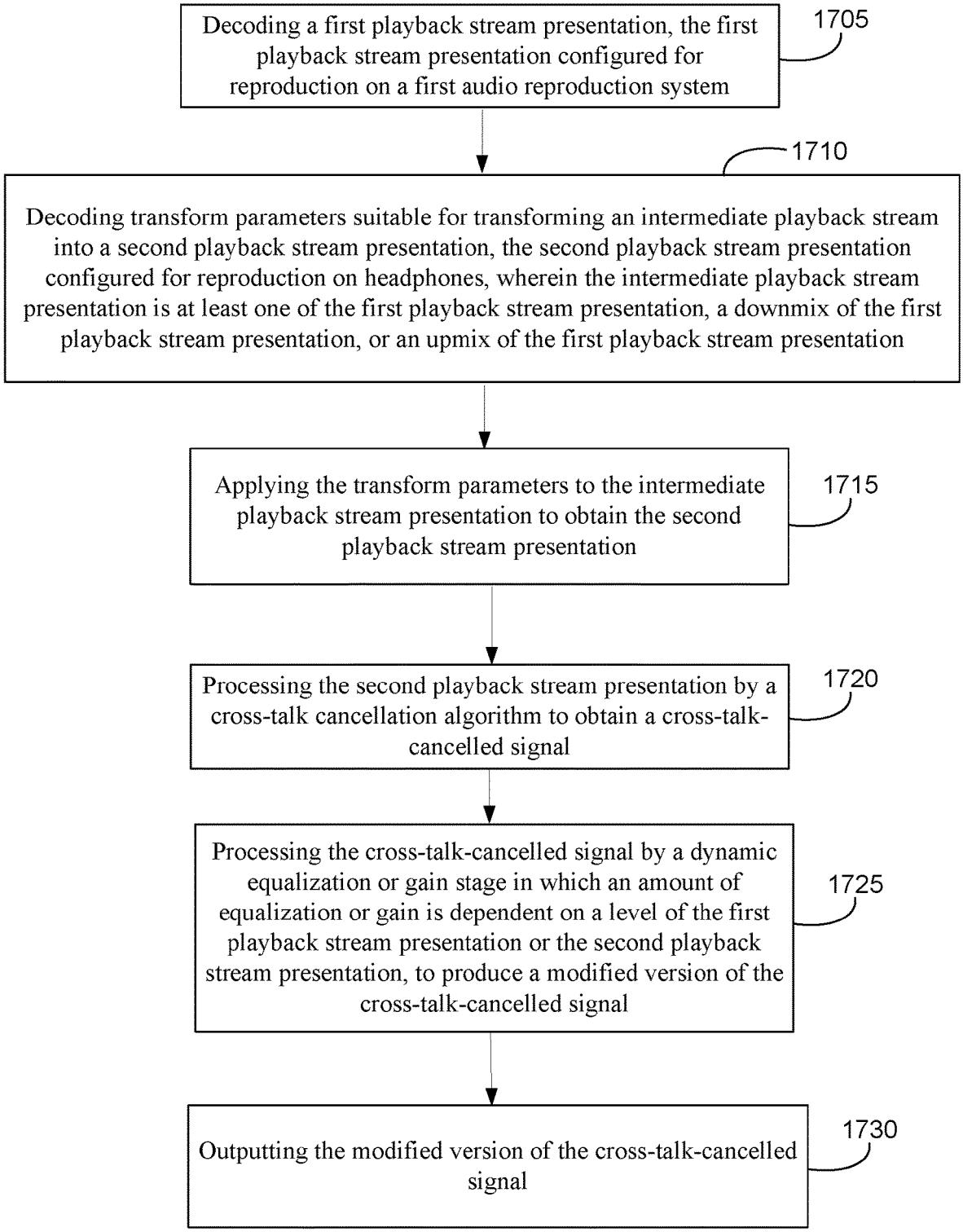
FIG. 17 is a flow diagram that outlines blocks of a method according to one example.

FIG. 17 is a flow diagram that outlines blocks of a method according to one example. The method may, in some instances, be performed by the apparatus of FIG. 16 or by another type of apparatus disclosed herein. In some examples, the blocks of method 1700 may be implemented via software stored on one or more non-transitory media. The blocks of method 1700, like other methods described herein, are not necessarily performed in the order indicated. Moreover, such methods may include more or fewer blocks than shown and/or described.

In this implementation, block 1705 involves decoding a first playback stream presentation. In this example, the first playback stream presentation is configured for reproduction on a first audio reproduction system.

According to this example, block 1710 involves decoding a set of transform parameters suitable for transforming an intermediate playback stream into a second playback stream presentation. In some implementations, first playback stream presentation and the set of transform parameters may be received via an interface, which may be a part of the interface system 1610 that is described above with reference to FIG. 16. In this example, the second playback stream presentation is configured for reproduction on headphones. The intermediate playback stream presentation may be the first playback stream presentation, a downmix of the first playback stream presentation, and/or an upmix of the first playback stream presentation.

In this implementation, block 1715 involves applying the transform parameters to the intermediate playback stream presentation to obtain the second playback stream presentation. In this example, block 1720 involves processing the second playback stream presentation by a cross-talk cancellation algorithm to obtain a cross-talk-cancelled signal. The cross-talk cancellation algorithm may be based, at least in part, on loudspeaker data. The loudspeaker data may, for example, include loudspeaker position data.

According to this example, block 1725 involves processing the cross-talk-cancelled signal according to a dynamic equalization or gain process, which may be referred to herein as a "dynamic equalization or gain stage," in which an amount of equalization or gain is dependent on a level of the first playback stream presentation or the second playback stream presentation. In some implementations, the dynamic equalization or gain may be frequency-dependent. In some examples, the amount of dynamic equalization or gain may be based, at least in part, on acoustic environment data. In some examples, the acoustic environment data may be frequency-dependent. According to some implementations, the acoustic environment data may include data that is representative of the direct-to-reverberant ratio at the intended listening position.

In this example, the output of block 1725 is a modified version of the cross-talk-cancelled signal. Here, block 1730 involves outputting the modified version of the cross-talk-cancelled signal. Block 1730 may, for example, involve outputting the modified version of the cross-talk-cancelled signal via an interface system. Some implementations may involve playing back the modified version of the cross-talk-cancelled signal on headphones.

Figure 18:
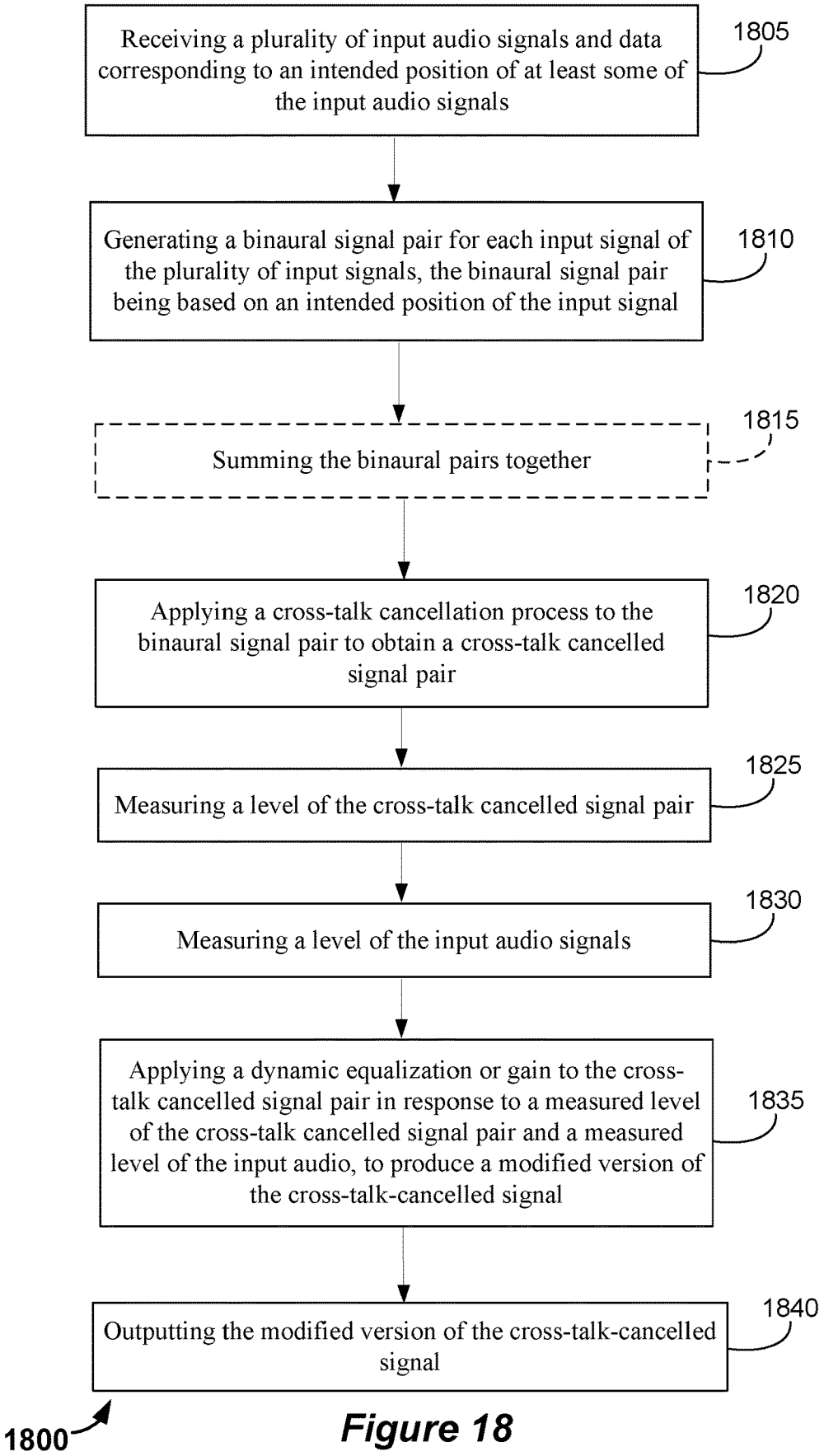
FIG. 18 is a flow diagram that outlines blocks of a method according to one example.

FIG. 18 is a flow diagram that outlines blocks of a method according to one example. The method may, in some instances, be performed by the apparatus of FIG. 16 or by another type of apparatus disclosed herein. In some examples, the blocks of method 1800 may be implemented via software stored on one or more non-transitory media. The blocks of method 1800, like other methods described herein, are not necessarily performed in the order indicated. Moreover, such methods may include more or fewer blocks than shown and/or described.

According to this example, method 1800 involves virtually rendering channel-based or object-based audio. In some examples, at least part of the processing of method 1800 may be implemented in a transform or filterbank domain.

In this implementation, block 1805 involves receiving a plurality of input audio signals and data corresponding to an intended position of at least some of the input audio signals. For example, block 1805 may involve receiving the input audio signals and data via an interface system.

Here, block 1810 involves generating a binaural signal pair for each input signal of the plurality of input signals. In this example, the binaural signal pair is based on an intended position of the input signal. In this implementation, optional block 1815 involves summing the binaural pairs together.

According to this example, block 1820 involves applying a cross-talk cancellation process to the binaural signal pair to obtain a cross-talk cancelled signal pair. The cross-talk cancellation process may involve applying a cross-talk cancellation algorithm that is based, at least in part, on loudspeaker data.

Here, block 1825 involves measuring (or estimating) a level of the cross-talk cancelled signal pair. According to this implementation, block 1830 involves measuring (or estimating) a level of the input audio signals. In some examples, level estimates may be based, at least in part, on summing the levels across channels or objects. In some implementations, level estimates may be based, at least in part, on one or more of energy, power, loudness or amplitude.

In this implementation, block 1835 involves applying a dynamic equalization or gain to the cross-talk cancelled signal pair in response to a measured level of the cross-talk cancelled signal pair and a measured level of the input audio. The dynamic equalization or gain may be based, at least in part, on a function of time or frequency. According to some examples, the amount of dynamic equalization or gain may be based, at least in part, on acoustic environment data. In some instances, the acoustic environment data may include data that is representative of the direct-to-reverberant ratio at the intended listening position. In some examples, the acoustic environment data may be frequency-dependent.

In this example, the output of block 1835 is a modified version of the cross-talk-cancelled signal. Here, block 1840 involves outputting the modified version of the cross-talk-cancelled signal. Block 1830 may, for example, involve outputting the modified version of the cross-talk-cancelled signal via an interface system. Some implementations may involve playing back the modified version of the cross-talk-cancelled signal on headphones.

Various modifications to the implementations described in this disclosure may be readily apparent to those having ordinary skill in the art. The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

The invention claimed is:

1. A method for virtually rendering channel-based or object-based audio, the method comprising:

receiving one or more input audio signals and data corresponding to an intended position of at least one of the one or more input audio signals;

generating a binaural signal pair for each input audio signal of the one or more input audio signals, the binaural signal pair being based on the corresponding intended position of the one or more input audio signals;

applying a cross-talk cancellation process to the binaural signal pair to obtain a cross-talk cancelled signal pair;

measuring a level of the cross-talk cancelled signal pair to obtain a measured level of the cross-talk cancelled signal pair;

measuring a level of the one or more input audio signals to obtain a measured input audio level;

applying a dynamic equalization or gain to the cross-talk cancelled signal pair in response to the measured level of the cross-talk cancelled signal pair and the measured input audio level, to determine a modified version of the cross-talk-cancelled signal pair; and outputting the modified version of the cross-talk-cancelled signal pair.

2. The method of claim 1, wherein the dynamic equalization or gain is based on a function of time or frequency.

3. The method of claim 1, wherein at least one or more of the measuring a level of the cross-talk cancelled signal pair and the measuring a level of the input audio signals is based on levels across channels or objects.

4. The method of claim 3, wherein the levels are based on one or more of energy, power, loudness or amplitude.

5. The method of claim 1, wherein at least part of the method is implemented in a transform or filterbank domain.

6. The method of claim 1, wherein the cross-talk cancellation process is based on loudspeaker data.

7. The method of claim 6, wherein the loudspeaker data comprises loudspeaker position data.

8. The method of claim 1, wherein an amount of dynamic equalization or gain is based on an acoustic environment data.

9. The method of claim 8, wherein the acoustic environment data includes data that is representative of a direct-to-reverberant ratio at an intended listening position.

10. The method of claim 8, wherein the acoustic environment data is frequency-dependent.

11. The method of claim 1, wherein the dynamic equalization or gain is frequency-dependent.

12. The method of claim 1, further comprising summing the binaural signal pairs together to produce a summed binaural signal pair, wherein the cross-talk cancellation process is applied to the summed binaural signal pair.

13. A non-transitory medium having software stored thereon, the software including instructions for performing the method of claim 1.

14. An apparatus, comprising:

a receiver configured to receive one or more input audio signals and data corresponding to an intended position of at least one of the one or more input audio signals;

a first processing unit configured to generate a binaural signal pair for each input audio signal of the one or more input audio signals, the binaural signal pair being based on the corresponding intended position of the one or more input audio signals;

a second processing unit configured to apply a cross-talk cancellation process to the binaural signal pair to obtain a cross-talk cancelled signal pair;

a third processing unit configured to measure a level of the cross-talk cancelled signal pair;

a fourth processing unit configured to measure a level of the one or more input audio signals to obtain a measured input audio level;

a fifth processing unit configured to apply a dynamic equalization or gain to the cross-talk cancelled signal pair in response to the measured level of the cross-talk cancelled signal pair and the measured input audio level, to determine a modified version of the cross-talk-cancelled signal pair; and an outputting unit configured to output the modified version of the cross-talk-cancelled signal pair.

15. The apparatus of claim 14, wherein the dynamic equalization or gain is based on a function of time or frequency.

16. The apparatus of claim 14, wherein at least one of the measuring a level of the cross-talk cancelled signal pair and the measuring a level of the input audio signals is based on levels across channels or objects.

17. The apparatus of claim 16, wherein the levels are based on one or more of energy, power, loudness or amplitude.

18. The apparatus of claim 14, wherein at least one processing unit is implemented in a transform or filterbank domain.

19. The apparatus of claim 14, wherein the cross-talk cancellation process is based on loudspeaker data.

20. The apparatus of claim 14, wherein an amount of dynamic equalization or gain is based on an acoustic environment data.

21. The apparatus of claim 14, further comprising a sixth processing unit configured to sum the binaural signal pairs together to produce a summed binaural signal pair, wherein the cross-talk cancellation process is applied to the summed binaural signal pair.

* * * * *